US009594342B2

(12) United States Patent
Fujiwara et al.

(10) Patent No.: US 9,594,342 B2
(45) Date of Patent: Mar. 14, 2017

(54) DEVELOPER CONTAINER, DEVELOPING APPARATUS, PROCESS CARTRIDGE, IMAGE FORMING APPARATUS, AND APPARATUS MAIN BODY OF IMAGE FORMING APPARATUS

(71) Applicant: CANON KABUSHIKI KAISHA, Tokyo (JP)

(72) Inventors: Akihiro Fujiwara, Mishima (JP); Yuuki Nakamura, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/046,558

(22) Filed: Feb. 18, 2016

(65) Prior Publication Data

US 2016/0252874 A1 Sep. 1, 2016

(30) Foreign Application Priority Data

Feb. 27, 2015 (JP) ..... 2015-039329

(51) Int. Cl.
*G03G 15/08* (2006.01)
*G03G 21/16* (2006.01)

(52) U.S. Cl.
CPC ..... *G03G 21/1652* (2013.01); *G03G 15/086* (2013.01); *G03G 21/1676* (2013.01)

(58) Field of Classification Search
USPC ... 399/9, 24, 25, 27–30, 107, 110, 111, 119, 399/120; 222/DIG. 1
See application file for complete search history.

(56) References Cited

U.S. PATENT DOCUMENTS 5,987,269 A * 11/1999 Allen ..... G03G 15/086 399/27
6,668,141 B2 12/2003 Kojima et al.
(Continued)

FOREIGN PATENT DOCUMENTS

JP 2002-091152 A 3/2002
JP 2003-195619 A 7/2003
(Continued)

OTHER PUBLICATIONS

European Search Report dated Jul. 7, 2016, in related European Patent Application No. 16156832.4.

*Primary Examiner* — Hoan Tran
(74) *Attorney, Agent, or Firm* — Fitzpatrick, Cella, Harper & Scinto

(57) ABSTRACT

A developing apparatus includes: a developing chamber that has a developer bearing member bearing developer, an accommodating chamber that has a concave portion and an opening and accommodates the developer under the developing chamber, a conveying member that conveys the developer by rotation; and a first detecting member and a second detecting member that detect an amount of the developer in use of capacitance. A part of the concave portion is within a turning radius of the conveying member. In addition, the first detecting member is provided on a downstream side in a rotating direction of the conveying member relative to the concave portion, and the second detecting member is provided on an upstream side in the rotating direction of the conveying member relative to the concave portion.

17 Claims, 19 Drawing Sheets

(56) References Cited

U.S. PATENT DOCUMENTS

| | | | | |
|---|---|---|---|---|
| 8,036,543 | B2 | 10/2011 | Yokomori et al. | |
| 9,250,567 | B2 * | 2/2016 | Watanabe | G03G 15/0865 |
| 2003/0123888 | A1 | 7/2003 | Naito et al. | |
| 2007/0206966 | A1 * | 9/2007 | Komiya | G03G 15/0856 399/27 |
| 2008/0247784 | A1 | 10/2008 | Kakuta et al. | |
| 2012/0121275 | A1 | 5/2012 | Kanai | |
| 2013/0308988 | A1 | 11/2013 | Hirukawa et al. | |

FOREIGN PATENT DOCUMENTS

| | | | |
|---|---|---|---|
| JP | 2003-323036 | A | 11/2003 |
| JP | 2006-106482 | A | 4/2006 |
| JP | 2008-209897 | A | 9/2008 |

* cited by examiner

DEVELOPER CONTAINER, DEVELOPING APPARATUS, PROCESS CARTRIDGE, IMAGE FORMING APPARATUS, AND APPARATUS MAIN BODY OF IMAGE FORMING APPARATUS

BACKGROUND OF THE INVENTION

Field of the Invention

The present invention relates to a developer container, a developing apparatus, a process cartridge, an image forming apparatus, and the apparatus main body of the image forming apparatus.

Description of the Related Art

Conventionally, image forming apparatuses adopting an electrophotographic image forming method (electrophotographic process) have developing apparatuses that supply developer to electrostatic latent images formed on photosensitive drums to develop the electrostatic latent images. In recent years, process cartridges in which process units such as photosensitive drums and charging rollers are integrated with developing apparatuses have been put to practical use. Where the process cartridges are attachable/detachable to/from image forming apparatuses, a maintenance operation such as filling of developer is facilitated.

In addition, the process cartridges generally have remaining toner amount detecting units that detect remaining toner amounts in the developing apparatuses. Users are allowed to replace the process cartridges when it is detected by the remaining toner amount detecting units that the remaining toner amounts in the developing apparatuses become small.

In technology disclosed in Japanese Patent Application Laid-open No. 2008-209897, detection light applied from a light emitting portion passes through the inside of a developer container that accommodates developer and is guided to a light receiving portion. The developer container has a stirring member that stirs the developer inside it, and the detection light is blocked by the developer when the stirring member conveys the developer to the light path of the detection light. Further, a remaining amount of toner accommodated in the developer container is detected by the detection of time at which the detection light is blocked.

In addition, in technology disclosed in Japanese Patent Application Laid-open No. 2002-091152, two electrodes are provided in a developing chamber having a developing roller, and a remaining amount of toner in a developer container is detected by the detection of the capacitance between the electrodes.

SUMMARY OF THE INVENTION

However, in the technology disclosed in Japanese Patent Application Laid-open No. 2008-209897, the developer scatters when the developer is stirred by the stirring member. As a result, there is a likelihood that the scattering developer blocks the detection light to cause reduction in the detecting accuracy of the remaining toner amount. In view of this, it is an object of the present invention to accurately detect an amount of developer.

An object of the present invention is to provide a developing apparatus comprising:

a developing chamber that has a developer bearing member bearing developer;

an accommodating chamber that has a concave portion and an opening and accommodates the developer under the developing chamber;

a conveying member that conveys the developer by rotation; and a first detecting portion and a second detecting portion that detect an amount of the developer in use of capacitance, wherein a part of the concave portion is within a turning radius of the conveying member, the first detecting portion is provided on a downstream side in a rotating direction of the conveying member relative to the concave portion, and the second detecting portion is provided on an upstream side in the rotating direction of the conveying member relative to the concave portion.

Another object of the present invention is to provide a process cartridge comprising:

a developing apparatus; and an image bearing member that bears a developer image, the developing apparatus having:

a developing chamber that has a developer bearing member bearing developer;

an accommodating chamber that has a concave portion and an opening and accommodates the developer under the developing chamber;

a conveying member that conveys the developer by rotation; and a first detecting portion and a second detecting portion that detect an amount of the developer in use of capacitance, wherein a part of the concave portion is within a turning radius of the conveying member, the first detecting portion is provided on a downstream side in a rotating direction of the conveying member relative to the concave portion, and the second detecting portion is provided on an upstream side in the rotating direction of the conveying member relative to the concave portion.

Another object of the present invention is to provide an image forming apparatus that has a developing apparatus and forms an image on a recording medium in use of developer, the developing apparatus having:

a developing chamber that has a developer bearing member bearing the developer;

an accommodating chamber that has a concave portion and an opening and accommodates the developer under the developing chamber, a conveying member that conveys the developer by rotation, and a first detecting portion and a second detecting portion that detect an amount of the developer in use of capacitance, wherein a part of the concave portion is within a turning radius of the conveying member, the first detecting portion is provided on a downstream side in a rotating direction of the conveying member relative to the concave portion, and the second detecting portion is provided on an upstream side in the rotating direction of the conveying member relative to the concave portion.

Another object of the present invention is to provide a developer container detachable from a developing unit having a developer bearing member, the developer container comprising:

an accommodating chamber that has a concave portion and an opening and accommodates developer;

a conveying member that conveys the developer by rotation; and a first detecting portion and a second detecting portion that detect an amount of the developer in use of capacitance, wherein a part of the concave portion is within a turning radius of the conveying member, the first detecting portion is provided on a downstream side in a rotating direction of the conveying member relative to the concave portion, and the second detecting portion is provided on an upstream side in the rotating direction of the conveying member relative to the concave portion.

Another object of the present invention is to provide an apparatus main body of an image forming apparatus from which a developer container is detachable, the developer container having an accommodating chamber that has a concave portion and an opening and accommodates developer and also having a conveying member that conveys the developer by rotation, a part of the concave portion being within a turning radius of the conveying member, the apparatus main body comprising:

a first detecting portion and a second detecting portion that detect a change in an amount of the developer in the developer container in use of capacitance when the developer container is attached to the apparatus main body; and a voltage applying portion that applies voltage to the first detecting portion and the second detecting portion, wherein the first detecting portion is provided on a downstream side in a rotating direction of the conveying member relative to the concave portion, and the second detecting portion is provided on an upstream side in the rotating direction of the conveying member relative to the concave portion.

According to an embodiment of the present invention, it is possible to accurately detect an amount of developer.

Further features of the present invention will become apparent from the following description of exemplary embodiments with reference to the attached drawings.

DESCRIPTION OF THE EMBODIMENTS

Hereinafter, a description will be given of the embodiments of the present invention with reference to the drawings. However, the sizes, materials, shapes, their relative arrangements, or the like of constituents described in the embodiments may be appropriately changed according to the configurations, various conditions, or the like of an apparatus to which the invention is applied, and the range of the invention is not limited to the following embodiments.

First Embodiment

Electrophotographic Image Forming Apparatus

Figure 1:
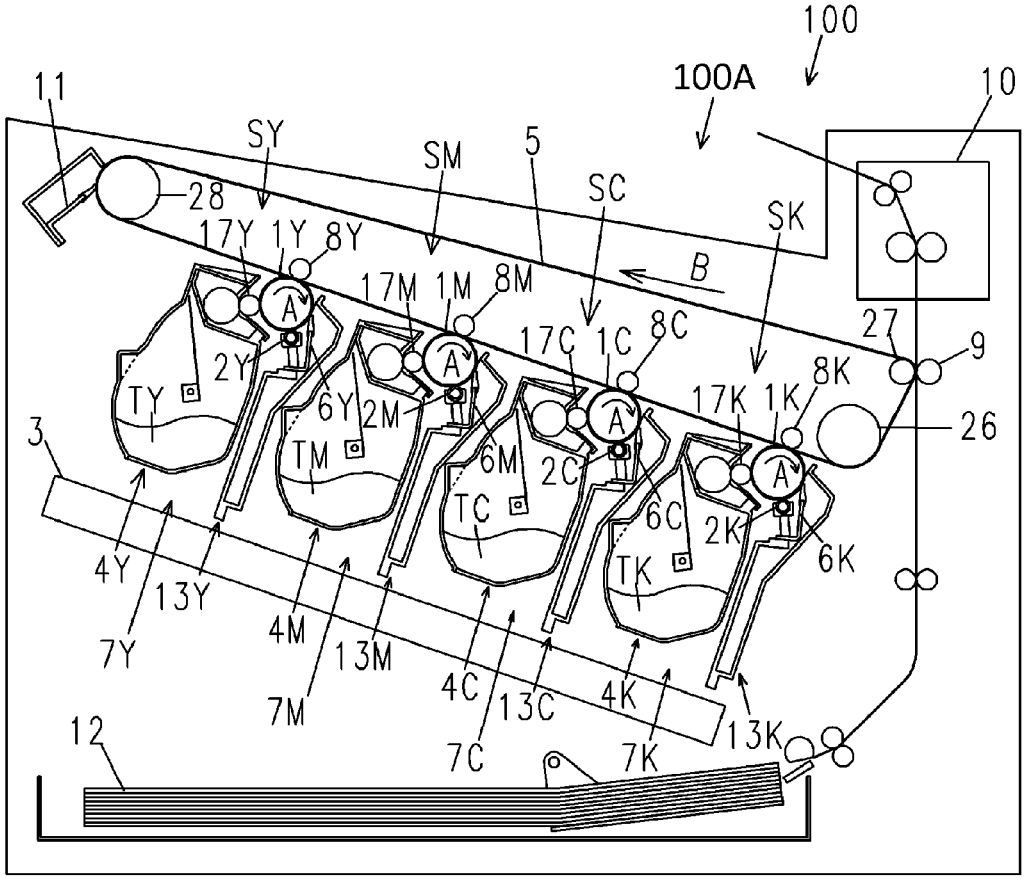
FIG. 1 is a schematic view of an image forming apparatus according to a first embodiment.
Figure 2:
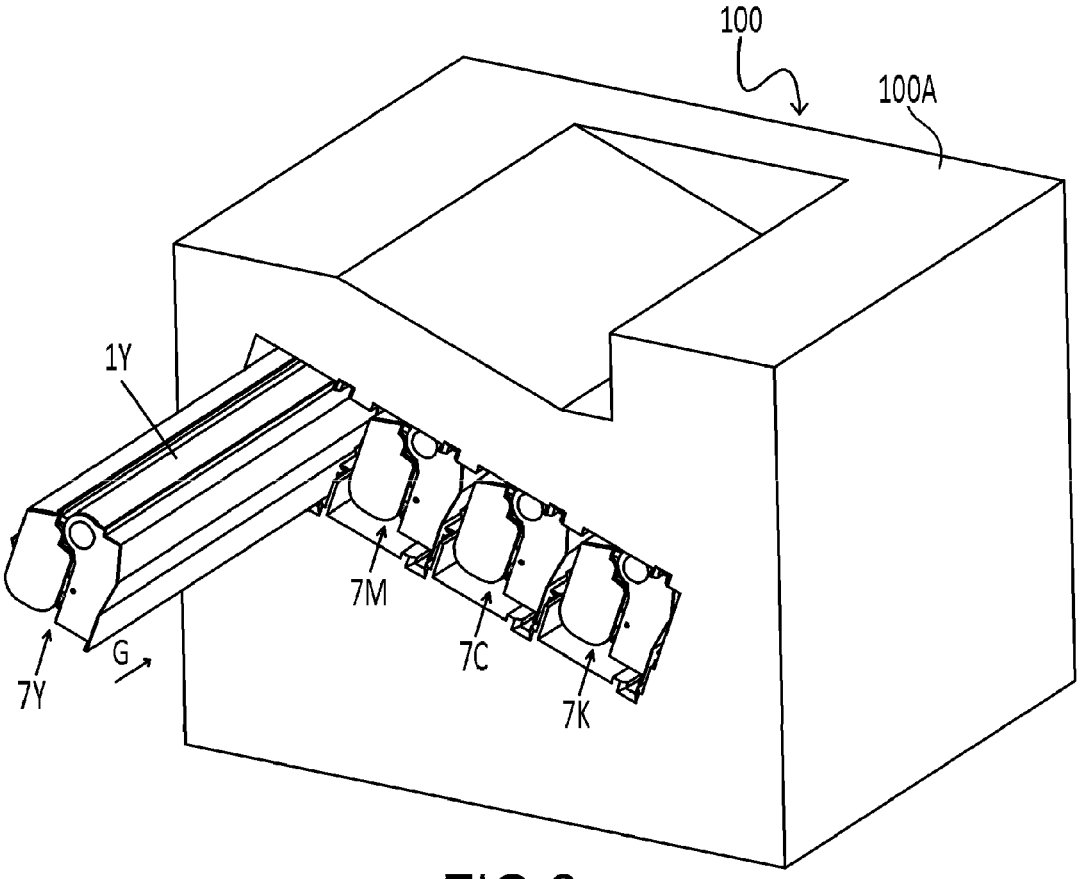
FIG. 2 is a perspective view of process cartridges and the image forming apparatus according to the first embodiment.

A description will be given, with reference to FIGS. 1 and 2, of the entire configuration of an electrophotographic image forming apparatus (image forming apparatus) according to a first embodiment. FIG. 1 is a schematic view of an image forming apparatus 100 according to the first embodiment. FIG. 2 is a perspective view showing a state in which a process cartridge 7 is inserted into the image forming apparatus 100. The image forming apparatus 100 has image forming sections SY, SM, SC, and SK, which are first to fourth image forming sections for forming images of yellow (Y), magenta (M), cyan (C), and black (K), respectively, as a plurality of image forming sections.

In the first embodiment, the configurations and operations of the first to fourth image forming sections are substantially the same except that image colors formed thereby are different from each other. Accordingly, the first to fourth image forming apparatuses will be hereinafter collectively described without the subscripts Y, M, C, and K when there is no need to distinguish the first to fourth image forming apparatuses. In the first embodiment, the image forming apparatus 100 has four photosensitive drums 1 (1Y, 1M, 1C, and 1K) (image bearing members). The photosensitive drum 1 rotates in a direction indicated by arrow A in FIG. 1. Around the photosensitive drum 1, a charging roller 2 (2Y, 2M, 2C, and 2K) and a scanner unit (exposing apparatus) 3 are arranged.

Here, the charging roller 2 is a charging unit that evenly charges the front surface of the photosensitive drum 1. The scanner unit 3 is an exposing unit that applies laser light based on image information to form an electrostatic latent image on the photosensitive drum 1. In addition, around the photosensitive drum 1, a developing unit 4 (4Y, 4M, 4C, and 4K) (hereinafter called a developing apparatus) and a cleaning blade 6 (6Y, 6M, 6C, and 6K) serving as a cleaning unit are arranged. Here, the developing unit 4 (developing apparatus) has at least a developing roller (developer bearing member) that bears developer.

Moreover, an intermediate transfer belt 5 is arranged facing the four photosensitive drums 1 as an intermediate transfer member for transferring toner images (developer images) on the photosensitive drums 1 onto a recording member (recording medium). Further, in the first embodiment, toner T (TY, TM, TC, TK) is used in the developing unit 4 as non-magnetic one-component developer. Note that in the first embodiment, the developing unit 4 causes the developing roller 17 (as a developer bearing member) serving as a developer bearing member to contact the photosensitive drum 1 to perform contact development.

In addition, the photosensitive unit 13 has a removed toner accommodating unit 14*a* (14*a*Y, 14*a*M, 14*a*C, and 14*a*K) (see FIG. 3) that accommodates untransferred toner (waste toner) remaining on the photosensitive drum 1, the photosensitive drum 1, the charging roller 2, and the cleaning blade 6. Moreover, in the first embodiment, the developing unit 4 and the photosensitive unit 13 are combined integrally into a cartridge to constitute a process cartridge 7 (7Y, 7M, 7C, and 7K). The process cartridge is attachable/detachable to/from the image forming apparatus 100 via an attaching unit such as an attaching guide and a positioning member (not shown) provided in the image forming apparatus 100. Further, the process cartridge 7 has at least the photosensitive drum 1 (image bearing member) that bears a developer image.

In the first embodiment, the process cartridge 7 is attachable to the image forming apparatus 100 in a direction indicated by arrow G in FIG. 2, the direction indicating the axis direction of the photosensitive drum 1. In the first embodiment, all the process cartridges 7 for the respective colors are the same in shape. However, the process cartridges 7 may be different in shape and size without being limited to this. For example, the cartridge for black may be larger in size than the other cartridges so as to have larger capacity. In addition, the process cartridges 7 for the respective colors accommodate the toner T (TY, TM, TC, and TK) of the respective colors of yellow (Y), magenta (M), cyan (C), and black (K), respectively. The intermediate transfer belt 5 contacts all the photosensitive drums 1 and moves in a direction indicated by arrow B in FIG. 1. The intermediate transfer belt 5 is laid over a plurality of supporting members (a driver roller 26, a secondary transfer facing roller 27, and a driven roller 28).

On the side of the inner peripheral surface of the intermediate transfer belt 5, four primary transfer rollers 8 (8Y, 8M, 8C, and 8K) serving as primary transfer units are provided side by side so as to face the respective photosensitive drums 1. Further, at a position facing the secondary transfer facing roller 27 on the side of the outer peripheral surface of the intermediate transfer belt 5, a secondary transfer roller 9 serving as a secondary transfer unit is arranged.

(Image Forming Processes)

At forming an image, the front surface of the photosensitive drum 1 is first evenly charged by the charging roller 2. Next, the front surface of the photosensitive drum 1 is subjected to scanning exposure by laser light applied from the scanner unit 3 to form an electrostatic latent image based on image information on the photosensitive drum 1. The electrostatic latent image formed on the photosensitive drum 1 is developed as a toner image by the developing unit 4. The toner image formed on the photosensitive drum 1 is primarily transferred onto the intermediate transfer belt 5 by the primary transfer roller 8.

For example, at forming a full-color image, the image forming sections SY, SM, SC, and SK serving as the first to fourth image forming sections successively perform the above processes to superimpose toner images of the respective colors on the intermediate transfer belt 5 one after another. After that, a recording member is conveyed to a secondary transfer section in synchronization with the movement of the intermediate transfer belt 5. Then, the toner images of the four colors on the intermediate transfer belt 5 are secondarily transferred onto the recording member in a lump by the secondary transfer roller 9 contacting the intermediate transfer belt 5 via the recording member.

Next, the recording member onto which the toner images have been transferred is conveyed to a fixing apparatus 10 serving as a fixing unit. The recording member is heated and pressed by the fixing apparatus 10 to fix the toner images on the recording member. Primarily untransferred toner remaining on the photosensitive drum 1 after the primary transfer process is removed by the cleaning blade 6. Further, secondarily untransferred toner remaining on the intermediate transfer belt 5 after the secondary transfer process is removed by an intermediate transfer belt cleaning apparatus 11. The removed untransferred toner (waste toner) is discharged into the waste toner box (not shown) of the image forming apparatus 100. Note that the image forming apparatus 100 is also capable of forming single-color or multicolor images using desired one or some (not all) of the image forming sections.

(Process Cartridge)

Figure 3:
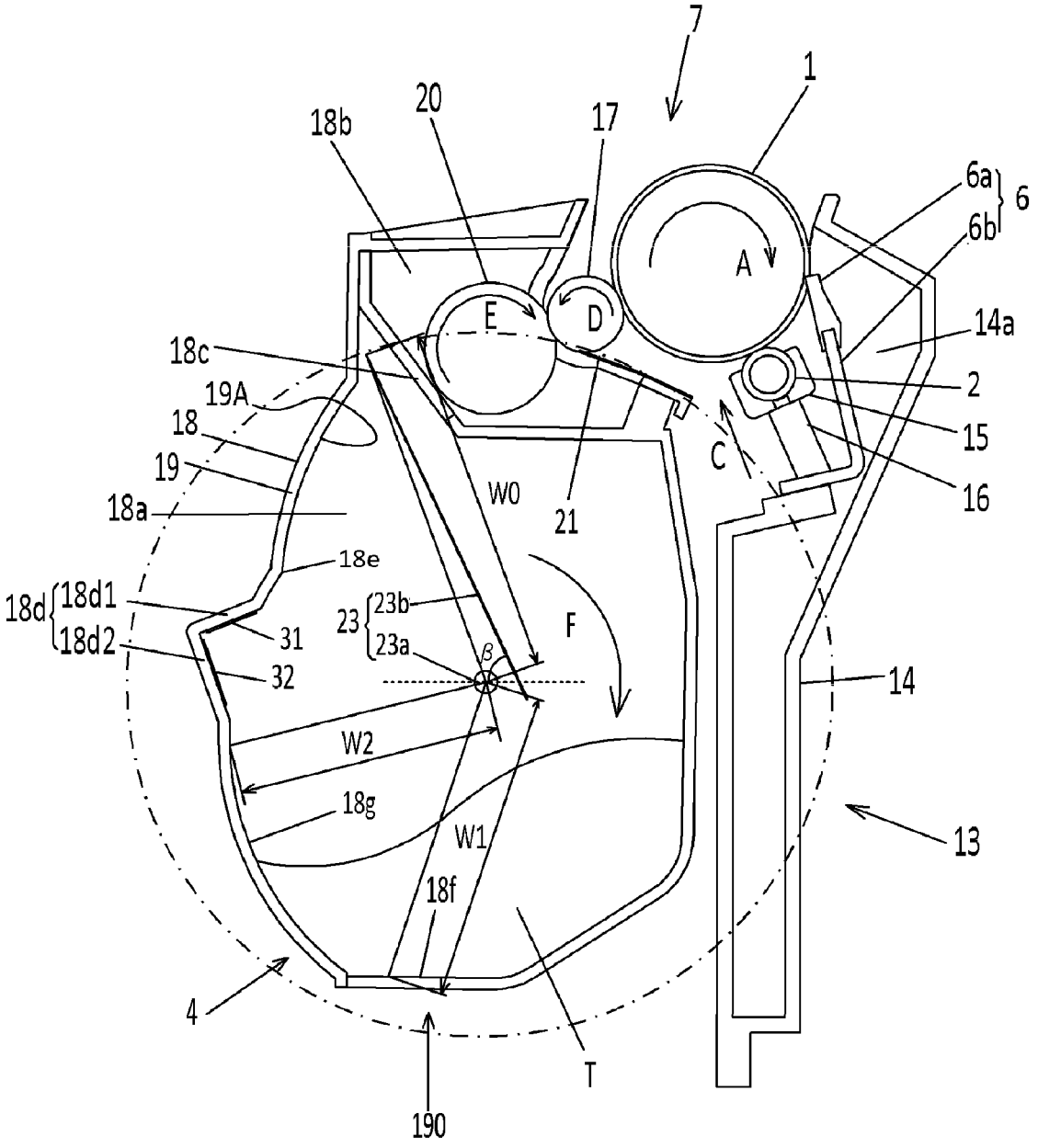
FIG. 3 is a schematic view of the process cartridge according to the first embodiment.

Next, a description will be given, with reference to FIG. 3, of the entire configuration of the process cartridge 7 attached to the image forming apparatus 100 according to the first embodiment. FIG. 3 is a schematic view of the process cartridge 7 according to the first embodiment. The developing unit 4 has a developing frame body 18 that supports various members inside it. Here, the portion of the developing frame body 18 that accommodates toner is defined as a container main body 19, and a configuration having the container main body 19, a stirring member 23 (conveying member), a first conductive member 31 (as a first detecting portion), and a second conductive member 32 (as a second detecting portion) is defined as a developer container 190. The developer container 190 has at least the container main body 19 that accommodates developer. Here, the first conductive member 31 and the second conductive member 32 correspond to a plurality of conductive members. The developing unit 4 has the developing roller 17 (as a developer bearing member) serving as a developer bearing member that conveys the toner to the photosensitive drum 1 when contacting the photosensitive drum 1. The developing roller 17 bears the toner and rotates in a direction (counterclockwise direction) indicated by arrow D in FIG. 3. In addition, the developing roller 17 is supported at both ends in its longitudinal direction (rotating axis direction) by the developing frame body 18 so as to be rotatable via a bearing. Here, in a concave portion 18*d*, the first conductive member 31 is provided on the upstream side of the second conductive member 32 in the rotating direction (F-direction) of the stirring member 23. While, in the concave portion 18*d*, the second conductive member 32 is provided on the downstream side of the first conductive member 31 in the rotating direction (F-direction) of the stirring member 23. Note that the developer container 190 may be attachable/detachable to/from the developing unit 4.

In addition, the developing unit 4 has a developer accommodating chamber 18*a* (hereinafter called a toner accommodating chamber) (accommodating chamber) as space inside the container main body 19, a developing chamber 18*b* in which the developing roller 17 (as a developer bearing member) is disposed, and an opening 18*c* that causes the toner accommodating chamber 18*a* and the developing chamber 18*b* to communicate with each other. In the first embodiment, the toner accommodating chamber 18*a* is positioned under the developing chamber 18*b*. In the developing chamber 18*b*, a toner supplying roller 20 serving as a developer supplying member that contacts the developing roller 17 and rotates in a direction indicated by arrow E and a developing blade 21 serving as a developer restricting member that restricts the thickness of a toner layer formed on the developing roller 17 are arranged.

In the toner accommodating chamber 18*a* representing the inside of the container main body 19 (inside the developer container) in the developer container 190, the stirring member 23 that stirs the accommodated toner T and conveys the toner to the toner supplying roller 20 via the opening 18*c* is provided. The stirring member 23 has a rotating shaft 23*a* parallel to the axial direction of the developing roller 17 and a stirring sheet 23*b* (sheet member) serving as a flexible sheet-shaped member. One end of the stirring sheet 23*b* is attached to the rotating shaft 23*a*, and the toner is stirred when the stirring sheet 23*b* rotates with the rotation of the rotating shaft 23*a*. The stirring member 23 rotates so as to slide relative to a region including at least a bottom portion 18*f* of an inner wall surface 19A of the container main body 19.

When the stirring member 23 stirs the toner, since the stirring sheet 23*b* contacts the inner wall surface 19A of the container main body 19, the stirring member 23 rotates, with the stirring sheet 23*b* being bent. Here, the inner wall surface 19A of the container main body 19 has a release position 18*e* at which the stirring sheet 23*b* is released from its bending state. The stirring sheet 23*b* is released from its bending state when passing through the release position 18*e*, and toner placed on the stirring sheet is bounced upward by a restoration force generated when the stirring sheet 23*b* is released from its bending state. The bounced toner is conveyed to the toner supplying roller 20 inside the developing chamber 18*b* via the opening 18*c*.

Figure 4A:
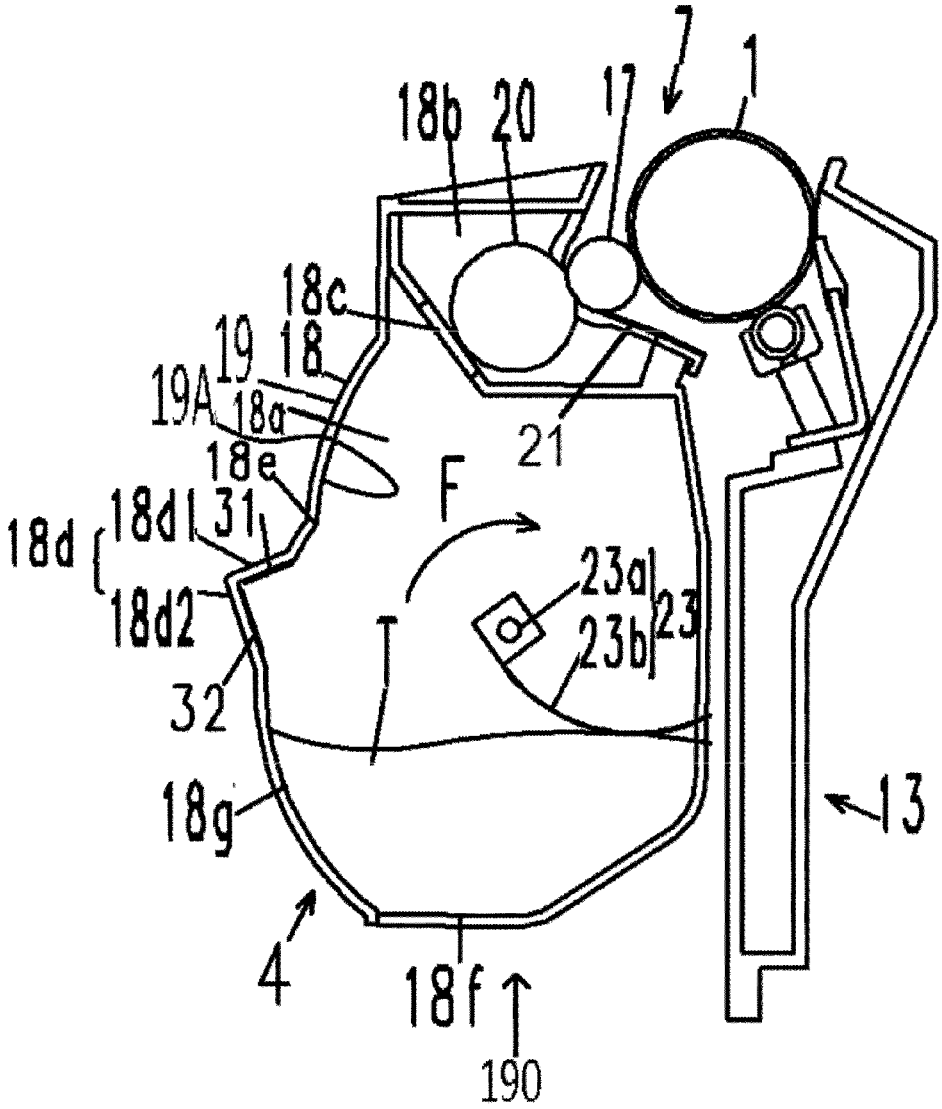
FIGS. 4A to 4E are views each showing a state in which developer is stirred.
Figure 4B:
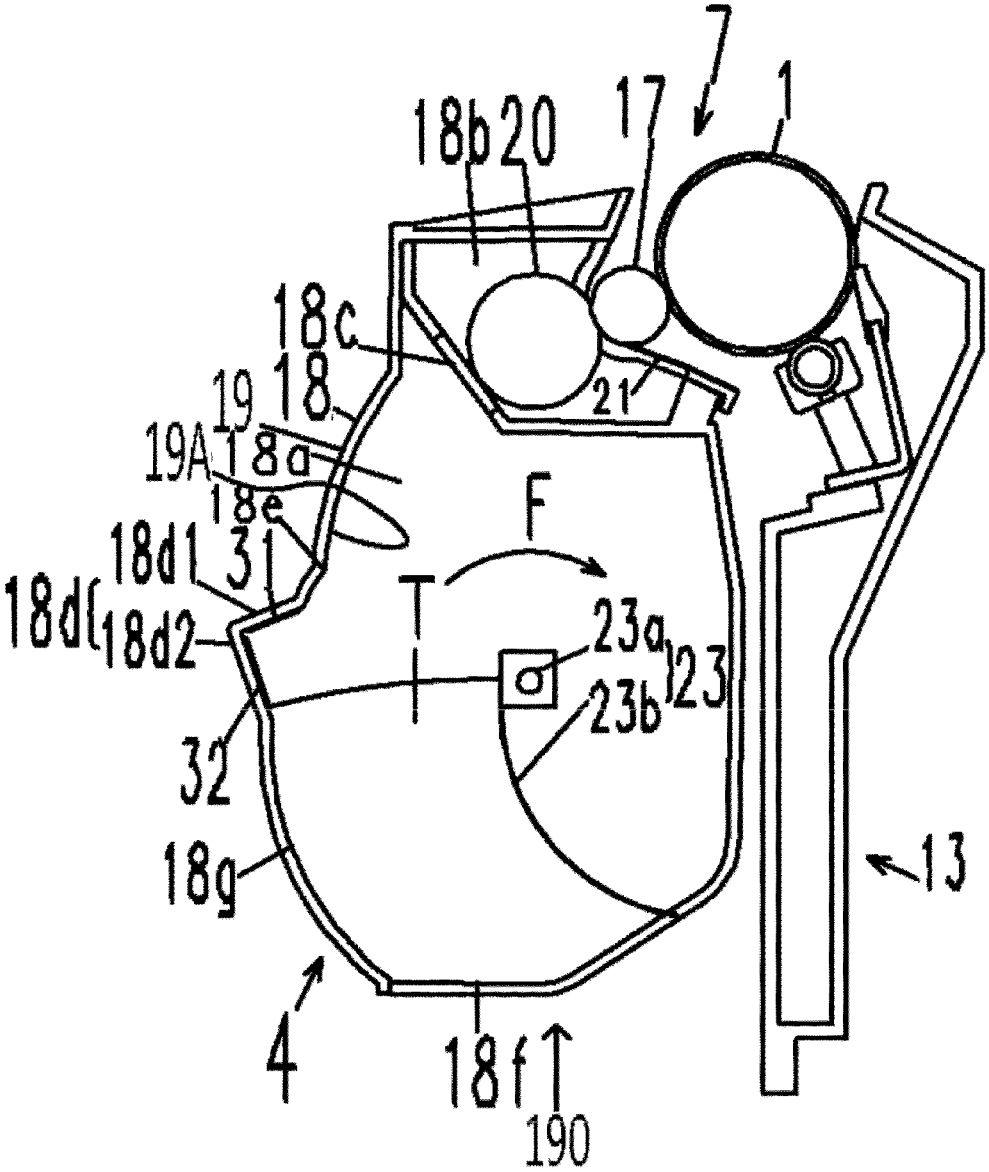
Figure 4C:
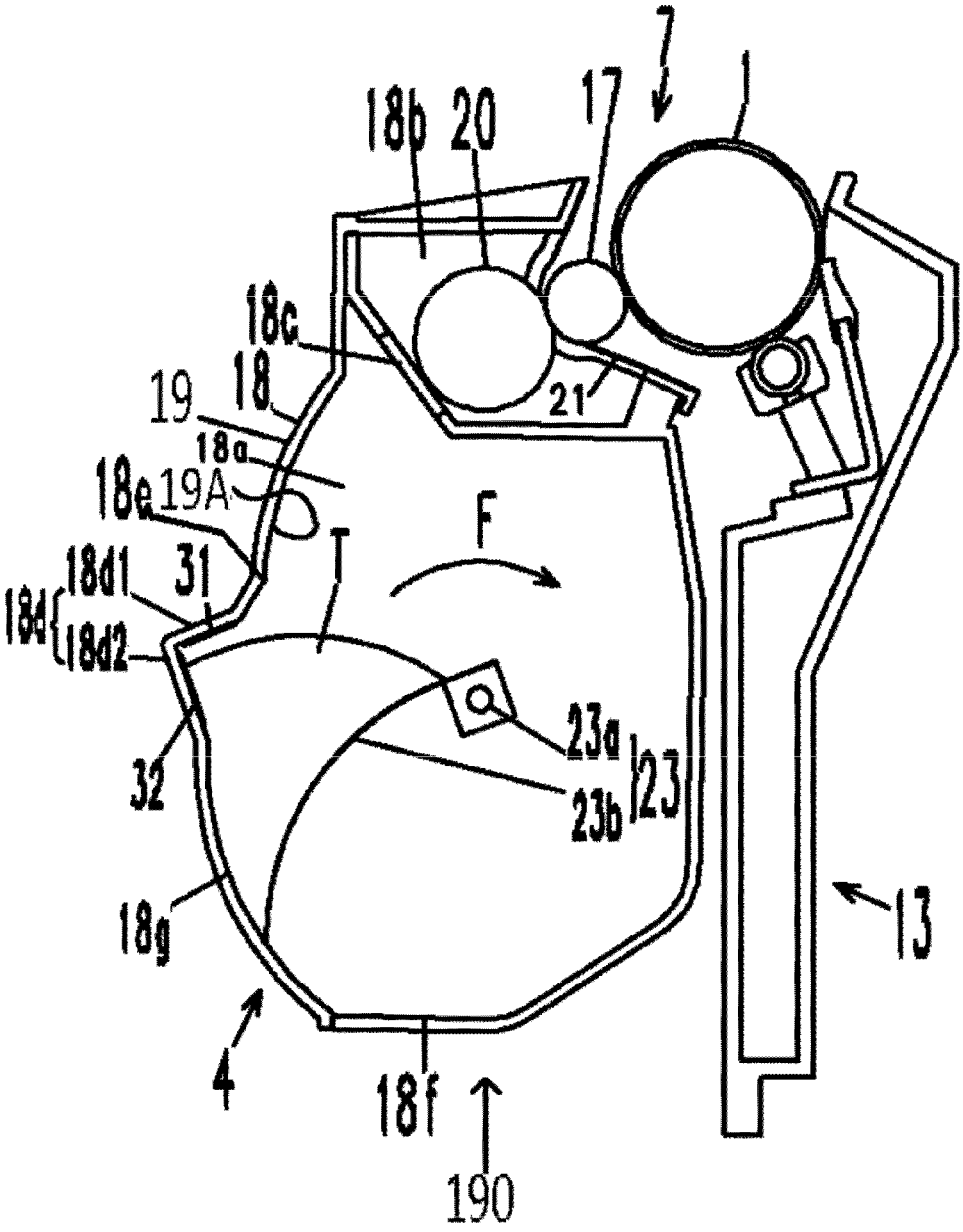

As shown in FIG. 3, a length W0 from the rotating shaft 23*a* to the tip end of the stirring sheet 23*b* (as a sheet member) is set to be longer than a length W1 from the rotating shaft 23*a* to the bottom portion 18*f* of the container main body 19 so that the toner stacked at the bottom portion 18*f* of the container main body 19 may be stirred and conveyed. Next, a description will be given, with reference to FIGS. 4A to 4E, of the states of the stirring sheet 23*b* and the toner when the stirring member 23 turns full circle. FIG. 4A shows a state of the toner when the stirring sheet 23*b* starts pushing the toner surface of the toner stacked at the bottom portion 18*f*. Then, as shown in FIGS. 4B and 4C, the stirring sheet 23*b* rotates in the direction indicated by the arrow F and lifts up the toner.

Figure 4D:
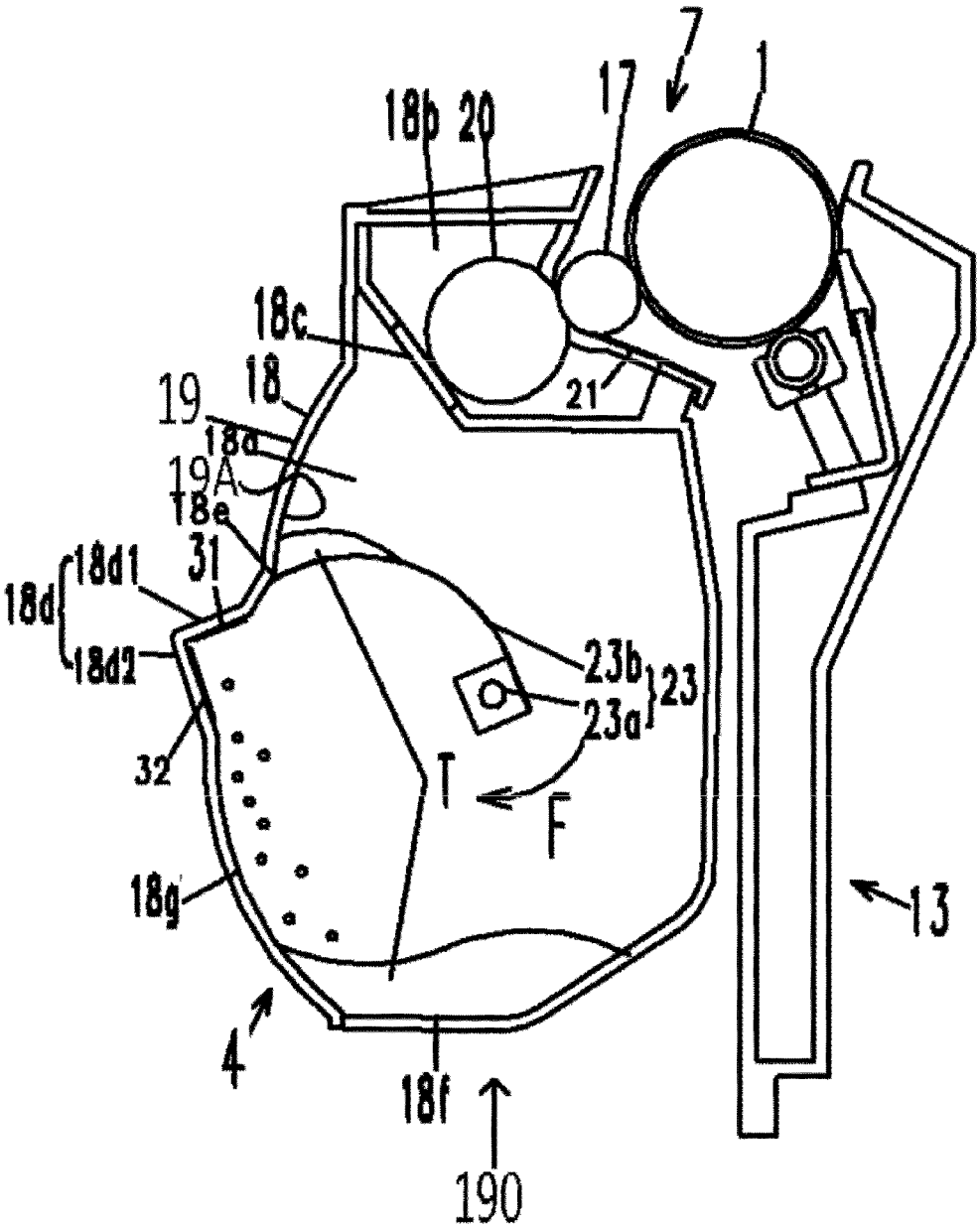
Figure 4E:
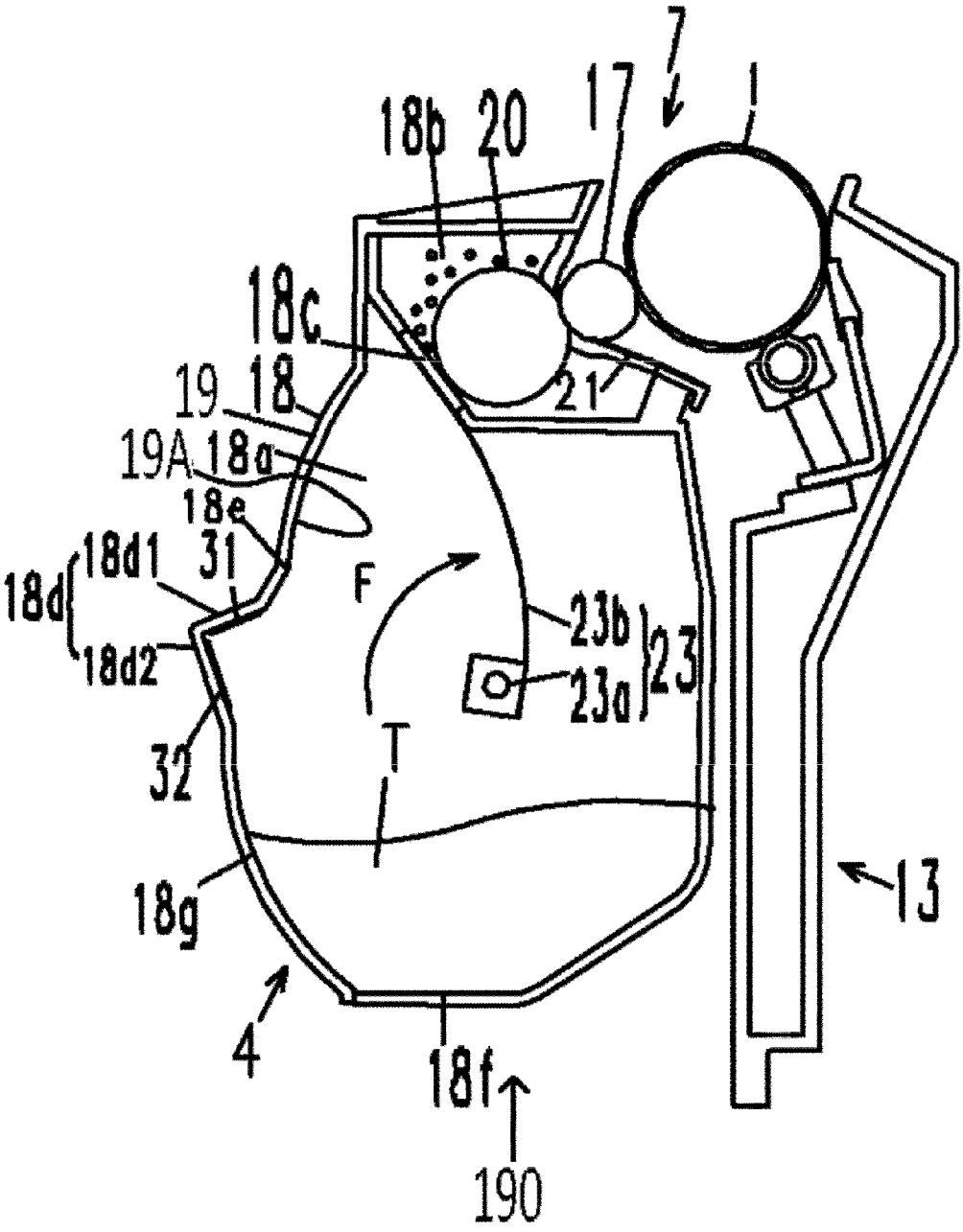

When the stirring sheet 23*b* (as a sheet member) further rotates in the direction indicated by the arrow F, the tip end of the stirring sheet 23*b* contacts the release position 18*e* as shown in FIG. 4D. The toner is placed on the stirring sheet 23*b* in this state, and the stirring sheet 23*b* is restored from its bending state to its initial state when the tip end of the stirring sheet 23*b* passes through the release position 18*e*. The toner placed on the stirring sheet 23*b* is bounced up toward the opening 18*c* by the restoration force and supplied to the toner supplying roller 20 via the opening 18*c*. When the stirring sheet 23*b* further rotates, it collides with the opening 18*c* and presses the toner into the developing chamber 18*b* as shown in FIG. 4E. After that, the stirring sheet 23*b* further rotates in the direction indicated by the arrow F, and the stirring sheet 23*b* and the toner are restored to their states shown in FIG. 4A again. The stirring sheet 23*b* continues rotating in the direction indicated by the arrow F, and the toner placed on the stirring sheet 23*b* is bounced upward every time the tip end of the stirring sheet 23*b* passes through the release position 18*e* and is conveyed to the developing chamber 18*b* via the opening 18*c*.

As shown in FIG. 3, the photosensitive unit 13 has a cleaning frame body 14 serving as a frame body that supports various elements inside the photosensitive unit 13. The photosensitive drum 1 is attached to the cleaning frame body 14 so that it may rotate in the direction indicated by the arrow A in FIG. 1 via a bearing member. In addition, a charging roller bearing 15 is attached to the cleaning frame body 14, and the charging roller 2 is attached to the charging roller bearing 15 so that the rotating axis of the charging roller 2 and the rotating axis of the photosensitive drum 1 are parallel to each other. Here, the charging roller bearing 15 is attached to the cleaning frame body 14 so that it may move in a direction indicated by arrow C in FIG. 3. Moreover, the charging roller 2 is attached to the charging roller bearing 15 so as to be rotatable. Further, the charging roller bearing 15 is biased to the photosensitive drum 1 by a charging roller pressing spring 16 serving as a biasing unit.

Further, the cleaning blade 6 is constituted by an elasticity member 6*a* that removes untransferred toner (waste toner) remaining on the front surface of the photosensitive drum 1 after the primary transfer process and a supporting member 6*b* that supports the elasticity member. The waste toner removed from the front surface of the photosensitive drum 1 by the cleaning blade 6 is accommodated in a removed toner accommodating portion 14*a* constituted by the cleaning blade 6 and the cleaning frame body 14.

(Configuration to Detect Remaining Toner Amount)

Figure 5:
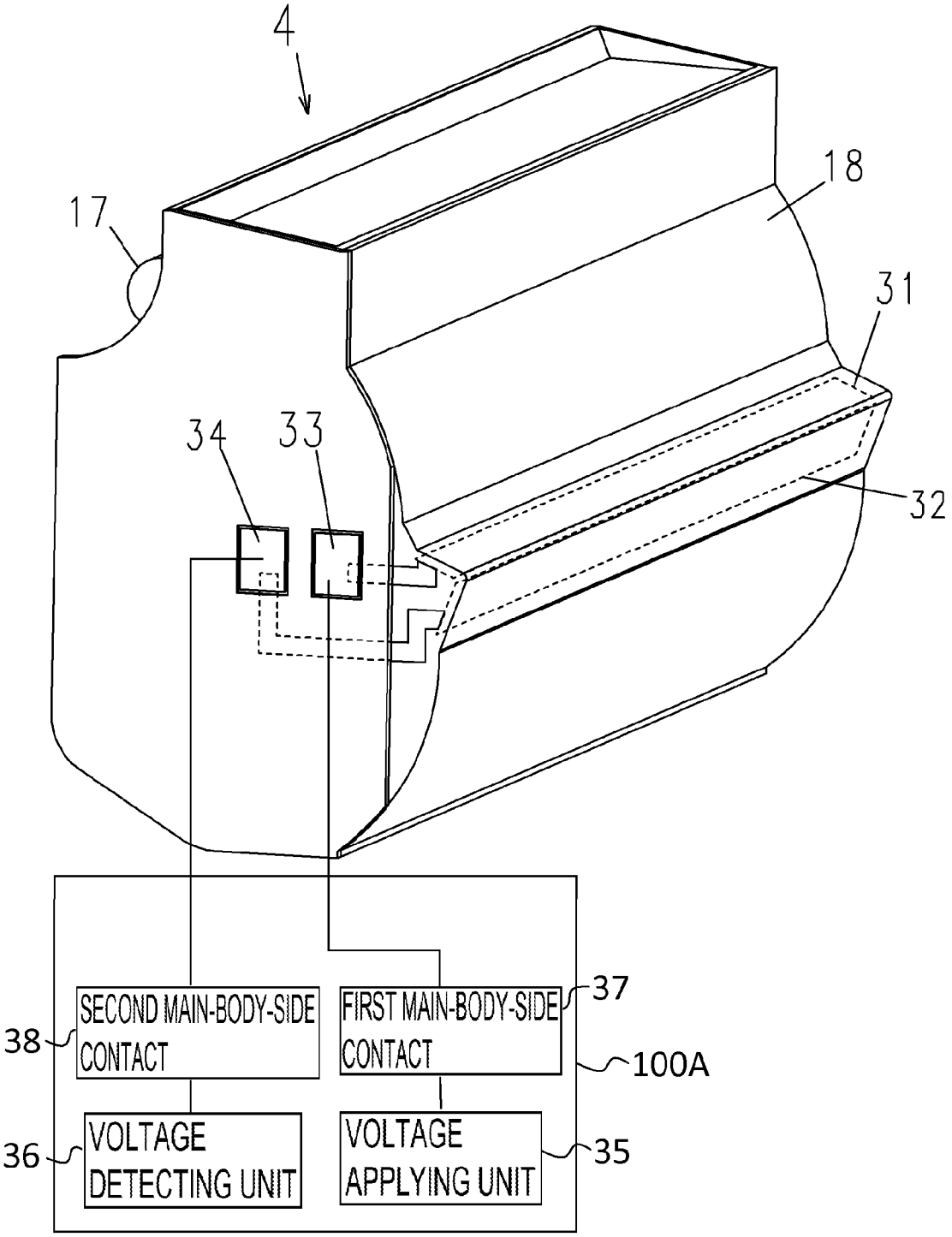
FIG. 5 is a perspective view of a developer container in a developing apparatus according to the first embodiment.
Figure 6:
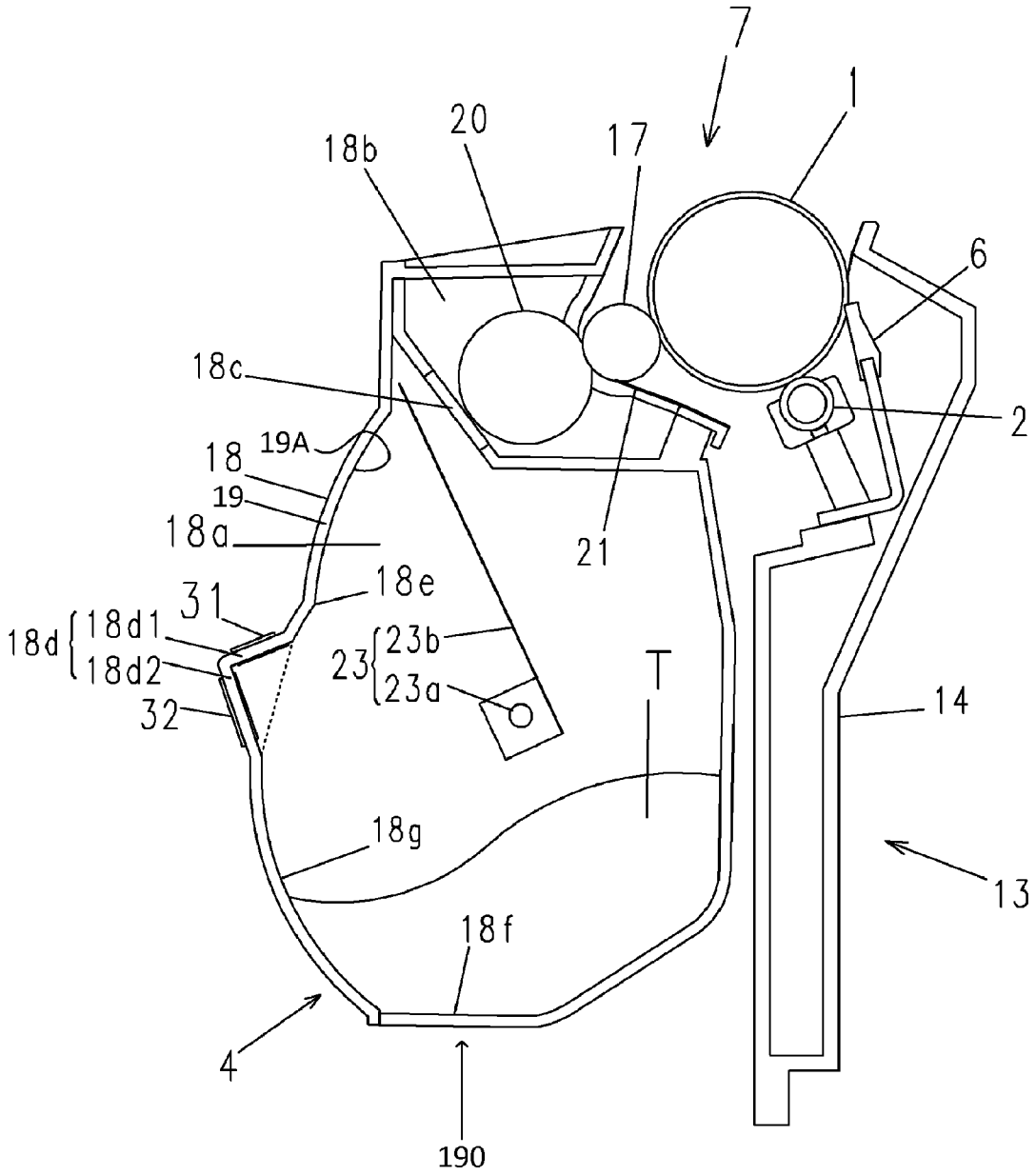
FIG. 6 is a schematic view of the process cartridge according to the first embodiment.
Figure 7:
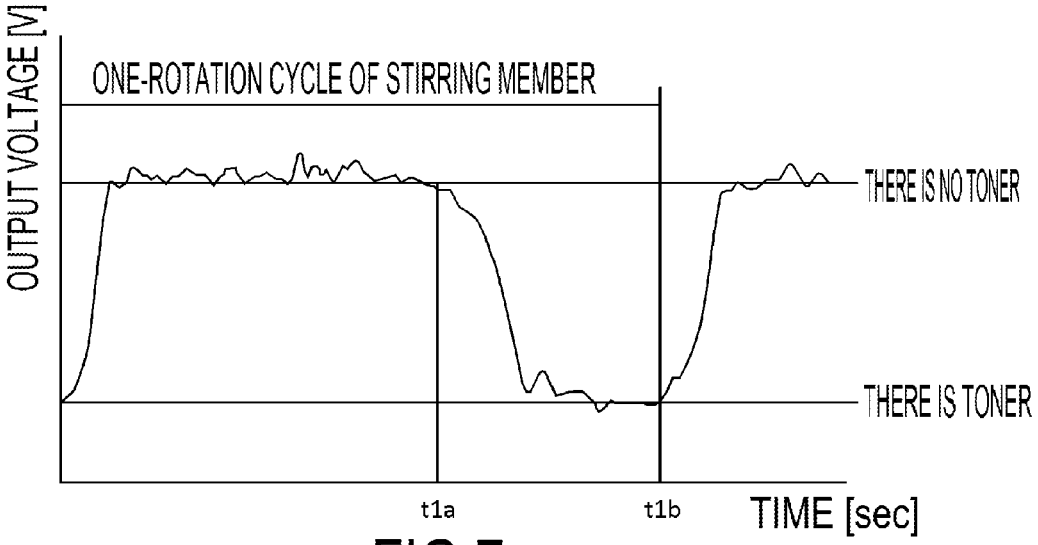
FIG. 7 is a graph showing a change in output voltage when an amount of the developer in the developing apparatus is large.
Figure 8:
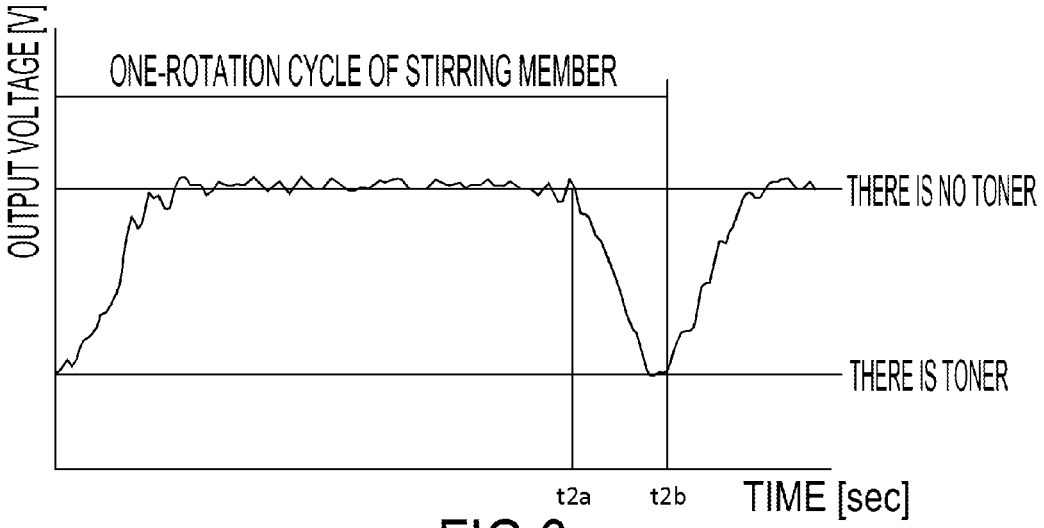
FIG. 8 is a graph showing a change in the output voltage when the amount of the developer in the developing apparatus is large.

Next, a description will be given, with reference to FIG. 3 to FIGS. 10A and 10B, of a configuration to detect a remaining toner amount (developer amount) in the toner accommodating chamber 18*a* (accommodating chamber). FIG. 3, FIGS. 4A to 4E, FIG. 6, FIGS. 9A and 9B, and FIGS. 10A and 10B are schematic views each showing the process cartridge 7. FIG. 5 is a perspective view of the developing unit. FIGS. 7 and 8 are graphs each showing the waveform of output voltage derived from capacitance (signal based on the capacitance). In the first embodiment, the capacitance between the first conductive member 31 (as a first detecting portion) and the second conductive member 32 (as a second detecting portion) is measured to detect the remaining toner amount.

Here, the detecting members may not be particularly limited so long as they are capable of detecting the capacitance and may be replaced by metal plates such as SUS or sheet members such as conductive resins. In the embodiment, conductive resin sheets in which carbon black serving as a conductive material is dispersed into a resin are used. The following description uses conductive members as modes of the detecting members.

(Configuration of Depressed Portion of Toner Accommodating Chamber)

As shown in FIG. 3, the inner wall surface 19A of the container main body 19 has the concave portion 18*d*. Of a wall surface 18*d*1 and a wall surface 18*d*2 of the concave portion 18*d*, the wall surface 18*d*1 has the first conductive member 31 and the wall surface 18*d*2 has the second conductive member 32. Here, the wall surface 18*d*1 is the downstream-side wall of the concave portion 18*d* in the rotating direction of the stirring member 23, and the wall surface 18*d*2 is the upstream-side wall of the concave portion 18*d* in the rotating direction of the stirring member 23. The angles of the first conductive member 31 and the second conductive member 32 relative to a horizontal surface are angles (angles of repose) at which the toner placed on the first conductive member 31 and the second conductive member 32 falls due to its own weight. That is, the toner entering the concave portion 18*d* is discharged from the concave portion due to its own weight. In addition, at least a part of the concave portion 18*d* falls within the turning radius of the stirring member 23. The length of the concave portion 18*d* in the longitudinal direction (G-direction) of the developing unit 4 is longer than the length of the stirring sheet 23*b* (as a sheet member) in the G-direction. In addition, the shape of the concave portion 18*d* when seen along the longitudinal direction (G-direction) of the developing unit 4 is a triangle. Note that in FIG. 6, a region on the side of the wall surface 18*d*1 and the wall surface 18*d*2 relative to a dotted line is the concave portion 18*d*.

Moreover, the concave portion 18*d* of the inner wall surface 19A of the container main body 19 is provided at a position free from the entering of the toner in a state in which the toner is not stirred by the stirring member 23. Specifically, in the toner accommodating chamber 18*a*, the concave portion 18*d* is positioned on an upstream side in the rotating direction of the stirring member 23 relative to the opening 18*c* and the release position 18*e* and positioned on a downstream side in the rotating direction of the stirring member 23 relative to the bottom portion 18*f* of the toner accommodating chamber 18*a*.

Here, in the embodiment, the angles of the first conductive member 31 (first detecting portion) and the second conductive member 32 (second detecting portion) relative to the horizontal surface are the angles of repose. Therefore, in a state in which the toner is not stirred in the container main body 19, the toner does not remain in the concave portion 18*d* while the toner entering the concave portion 18*d* is discharged from the concave portion 18*d* due to its own weight. Further, the concave portion 18*d* is provided at a position where the stirring sheet 23*b* (sheet member) passes through before an angle β of the stirring sheet 23*b* reaches an angle at which the toner placed on the stirring sheet 23*b* falls off the stirring sheet 23*b* after the stirring sheet 23*b* passes through the bottom portion 18*f*.

As shown in FIG. 3, the inner wall surface 19A of the container main body 19 has a conveyance restricting surface 18*g*, and a distance W2 from the rotating shaft 23*a* of the stirring member 23 to the conveyance restricting surface 18*g* is set to be shorter than a distance W0 from the rotating shaft 23*a* to the tip end of the stirring sheet 23*b*. In addition, distances from the wall surface 18*d*1 and the wall surface 18*d*2 to the rotating shaft 23*a* are set to be longer than the distance W2. A distance from a part of the wall surface 18*d*1 on the side closer to the rotating shaft 23*a* to the rotating shaft 23*a* and a distance from a part of the wall surface 18*d*2 on the side closer to the rotating shaft 23*a* to the rotating shaft 23*a* are set to be shorter than the distance W0.

Like this, the distances from the wall surface 18*d*1 and the wall surface 18*d*2 to the rotating shaft 23*a* are set to be longer than the distance W2. Thus, at the conveyance of the toner with the conveyance restricting surface 18*g* and the stirring sheet 23*b* (as a sheet member), the toner may be conveyed without hindering the track of the stirring sheet 23*b*. In addition, as described above, the distance from the part of the wall surface 18*d*1 on the side closer to the rotating shaft 23*a* and the part of the wall surface 18*d*2 on the side closer to the rotating shaft 23*a* to the rotating shaft 23*a* are set to be shorter than the distance W0. Thus, the toner placed on the stirring sheet 23*b* is pressed into the concave portion 18*d* by the stirring member 23, whereby the concave portion 18*d* may be stably filled with the toner.

(Description of States when Toner Enters/Leaves Depressed Portion)

Next, a description will be given, with reference to FIGS. 4A to 4E, of states in which the toner enters/leaves the concave portion 18*d* with the stirring member 23. FIG. 4A shows a state in which the stirring sheet 23*b* (as a sheet member) starts pushing the toner surface of the toner stacked at the bottom portion 18*f*. In this state, the toner does not enter the concave portion 18*d*. After that, when the stirring sheet 23*b* rotates in the direction indicated by the arrow F and the toner is lifted up by the stirring sheet 23*b* as shown in FIG. 4B, the toner starts entering the concave portion 18*d*. When the stirring sheet 23*b* further rotates in the direction indicated by the arrow F, the toner enters the concave portion 18*d* as shown in FIG. 4C. Since the toner in the concave portion 18*d* is pressed by the stirring sheet 23*b* in this state, it remains in the concave portion 18*d*.

Then, when the stirring sheet 23*b* further rotates, the stirring sheet 23*b* passes through the concave portion 18*d* as shown in FIG. 4D. After the stirring sheet 23*b* passes through the concave portion 18*d*, the concave portion 18*d* is opened and the toner in the concave portion 18*d* falls due to its own weight. Next, when the tip end of the stirring sheet 23*b* passes through the release position 18*e*, the toner placed on the stirring sheet 23*b* is bounced up toward the opening 18*c* as described above. After that, as shown in FIG. 4E, the stirring sheet 23*b* collides with the opening 18*c*, and the toner is pressed into the developing chamber 18*b* by the stirring sheet 23*b*.

Then, the stirring sheet 23*b* further rotates in the direction indicated by the arrow F, and the stirring sheet 23*b* and the toner are restored to their states shown in FIG. 4A again. Like this, the toner enters/leaves the concave portion 18*d* when the stirring member 23 rotates in the direction indicated by the arrow F, and the toner enters the concave portion 18*d* in the states shown in FIGS. 4B, 4C, and 4D. While, the toner does not enter the concave portion 18*d* in the states shown in FIGS. 4D, 4E, 4A, and 4B.

(Arrangement of Depressed Portion)

As described above, the toner enters the concave portion 18*d* from the state in which the toner surface is pressed by the stirring sheet 23*b* (as a sheet member) to the state before the stirring sheet 23*b* passes through the release position 18*e*. Since the toner placed on the stirring sheet 23*b* is bounced upward after the stirring sheet 23*b* passes through the release position 18*e*, the toner in the container main body 19 is brought into an unstable state, which is not suitable for detecting the presence and absence of the toner in the concave portion 18*d*. Here, if the concave portion 18*d* is positioned at the bottom portion 18*f*, the shape of the concave portion 18*d* is upwardly opened. Therefore, since the toner in the concave portion 18*d* may not fall due to its own weight, the toner enters the concave portion 18*d* at all times.

Accordingly, the concave portion 18*d* is desirably provided above the bottom portion 18*f* so that the toner in the concave portion 18*d* is discharged from the concave portion 18*d* after the stirring sheet 23*b* passes through the concave portion 18*d*. In addition, the inner walls of the concave portion 18*d* are desirably formed to have the angles (angles of repose) at which the toner in the concave portion 18*d* is discharged due to its own weight. Moreover, if the concave portion 18*d* is buried under the toner accommodated in the container main body 19, the toner enters the concave portion 18*d* even after the stirring sheet 23*b* passes through the concave portion 18*d*. Therefore, it becomes difficult to detect whether the toner has entered the concave portion 18*d*. Accordingly, the concave portion 18*d* is desirably provided on the upstream side of the release position and on the downstream side of the bottom portion 18*f* in the rotating direction (F-direction) of the stirring member 23 and desirably provided at a higher position of the inner wall surface 19A of the container main body 19.

(Arrangement of Conductive Members)

In the first embodiment, the first conductive member 31 (as a first detecting portion) and the second conductive member 32 (as a second detection portion) are provided in the concave portion 18*d* so as to be substantially parallel to the rotating axis direction of the developing roller 17 (as a developer bearing member) and provided at intervals. In addition, as shown in FIG. 5, the first conductive member 31 and the second conductive member 32 extend up to the end of the container main body 19 in the rotating axis direction of the developing roller 17. In general, the capacitance between conductive members increases with an increase in the areas of the conductive members. Therefore, the areas of the first conductive member 31 and the second conductive member 32 increase with the extension of the first conductive member 31 and the second conductive member 32, whereby a change in capacitance may be increased when the toner passes through the region between the first conductive member 31 and the second conductive member 32. The increase in the capacitance facilitates the accurate detection of a remaining toner amount in a remaining toner amount detecting method that will be described later.

(Unit for Conducting Image Forming Apparatus)

As shown in FIG. 5, the side surface of the container main body 19 on the downstream side in the attaching direction (see FIG. 2) of the process cartridge 7 has a first contact portion 33 and a second contact portion 34. In a state in which the process cartridge 7 is attached to the apparatus main body of the image forming apparatus 100, the first contact portion 33 is electrically connected to a first main-body-side contact 37 provided in the apparatus main body and the second contact portion 34 is electrically connected to a second main-body-side contact 38 provided in the apparatus main body. In addition, the first main-body-side contact 37 is electrically connected to a voltage applying unit 35 (as a voltage applying portion), and the second main-body-side contact 38 is electrically connected to a voltage detecting unit 36. The voltage applying unit 35 (voltage applying portion) applies voltage to the first contact portion 33 via the first main-body-side contact 37, and the voltage detecting unit 36 detects the voltage based on the capacitance between the first conductive member 31 (as a first detecting portion) and the second conductive member 32 (as a second detecting portion) via the second contact portion 34. In the first embodiment, the voltage applying unit 35 (as a voltage applying portion) and the voltage detecting unit 36 are provided on the side of an apparatus main body 100A of the image forming apparatus 100. Note that it may be possible to apply voltage to the second contact portion 34 and detect the voltage from the first contact portion 33. Note that in the first embodiment although the first conductive member 31 and the second conductive member 32 are provided on the inner wall surface 19A of the container main body 19 as shown in FIG. 3, they may be provided on the outer wall surface of the container main body 19 as shown in FIG. 6. Note that current flowing into the first contact portion 33 when the voltage applying unit 35 applies voltage to the first contact portion 33 is alternating current. Further, AC (alternating current) may be applied to DC (direct current). Further, although detection is made possible with DC (direct current), a particular circuit for changing capacitance is desirably required.

(Remaining Toner Amount Detecting Method)

Since the toner has a dielectric constant higher than that of air, the capacitance between the first conductive member 31 and the second conductive member 32 (as a second detecting portion) increases when the toner enters the region between the first conductive member 31 and the second conductive member 32. Accordingly, the capacitance between the first conductive member 31 and the second conductive member 32 increases when the toner conveyed by the stirring member 23 passes through the region between the first conductive member 31 and the second conductive member 32. On the other hand, when the stirring member 23 passes through the concave portion 18*d* and the toner between the first conductive member 31 and the second conductive member 32 falls due to its own weight, the capacitance between the first conductive member 31 and the second conductive member 32 decreases. Further, as described above, voltage is applied to the first conductive member 31 via the first contact portion 33, and a change in the voltage based on a change in the capacitance is detected via the second contact portion 34 connected to the second conductive member 32. Here, it is shown in FIGS. 7 and 8 that output voltage decreases when the capacitance between the first conductive member 31 and the second conductive member 32 increases and the output voltage increases when the capacitance between the first conductive member 31 and the second conductive member 32 decreases.

Figure 9A:
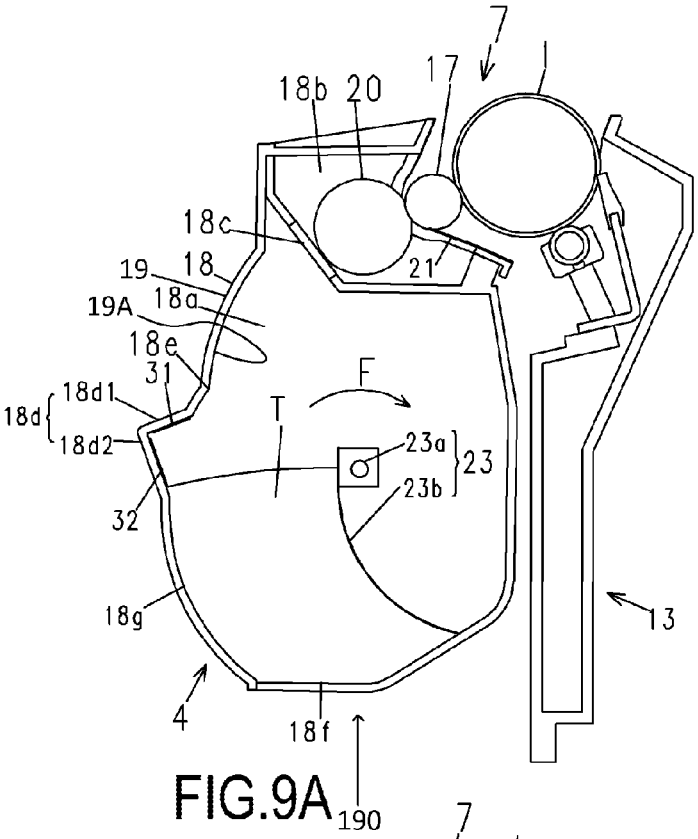
FIGS. 9A and 9B are views each showing a state in which the developer is stirred when the amount of the developer in the developing apparatus is large.
Figure 9B:
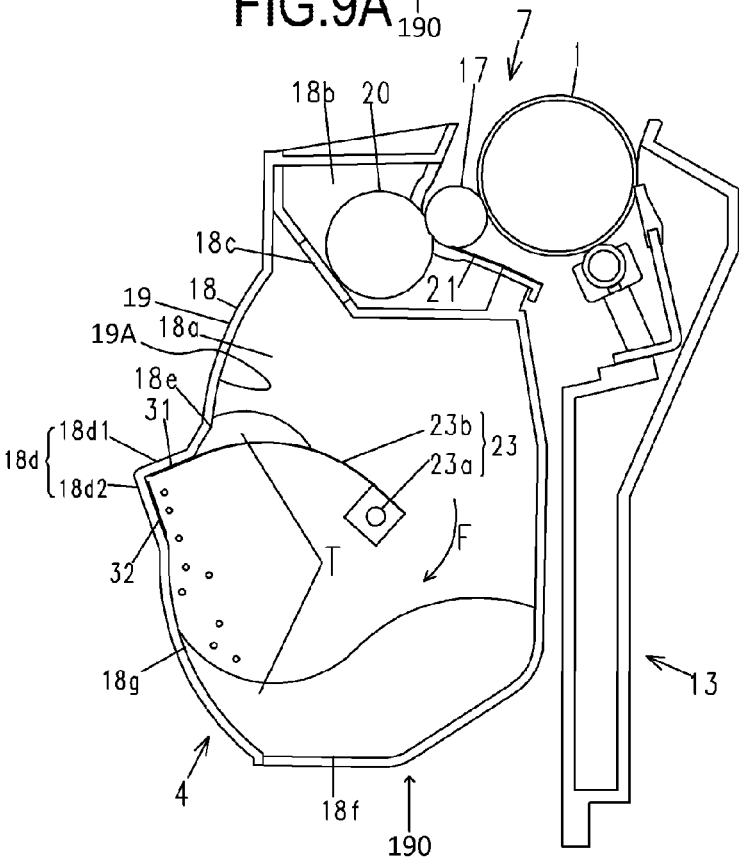

Next, a description will be given of a change in time at which the toner passes through the region between the first conductive member 31 and the second conductive member 32 when the remaining toner amount in the container main body 19 changes. FIGS. 9A and 9B show the states of the process cartridge 7 when the remaining toner amount in the container main body 19 is large. FIG. 9A shows a state in which the stirring sheet 23*b* (as a sheet member) pushes the toner surface and the toner starts entering the region between the first conductive member 31 and the second conductive member 32. This state corresponds to timing at time t1*a* in FIG. 7, and the output voltage based on the capacitance starts decreasing at this timing. On the other hand, FIG. 9B shows the state of the process cartridge 7 immediately after the stirring sheet 23*b* passes through the concave portion 18*d*. When the stirring sheet 23*b* passes through the concave portion 18*d*, the toner entering the concave portion 18*d* falls due to its own weight and is discharged from the region between the first conductive member 31 and the second conductive member 32. This state corresponds to timing at time t1*b* in FIG. 7, and the output voltage based on the capacitance starts increasing at this timing.

Figure 10A:
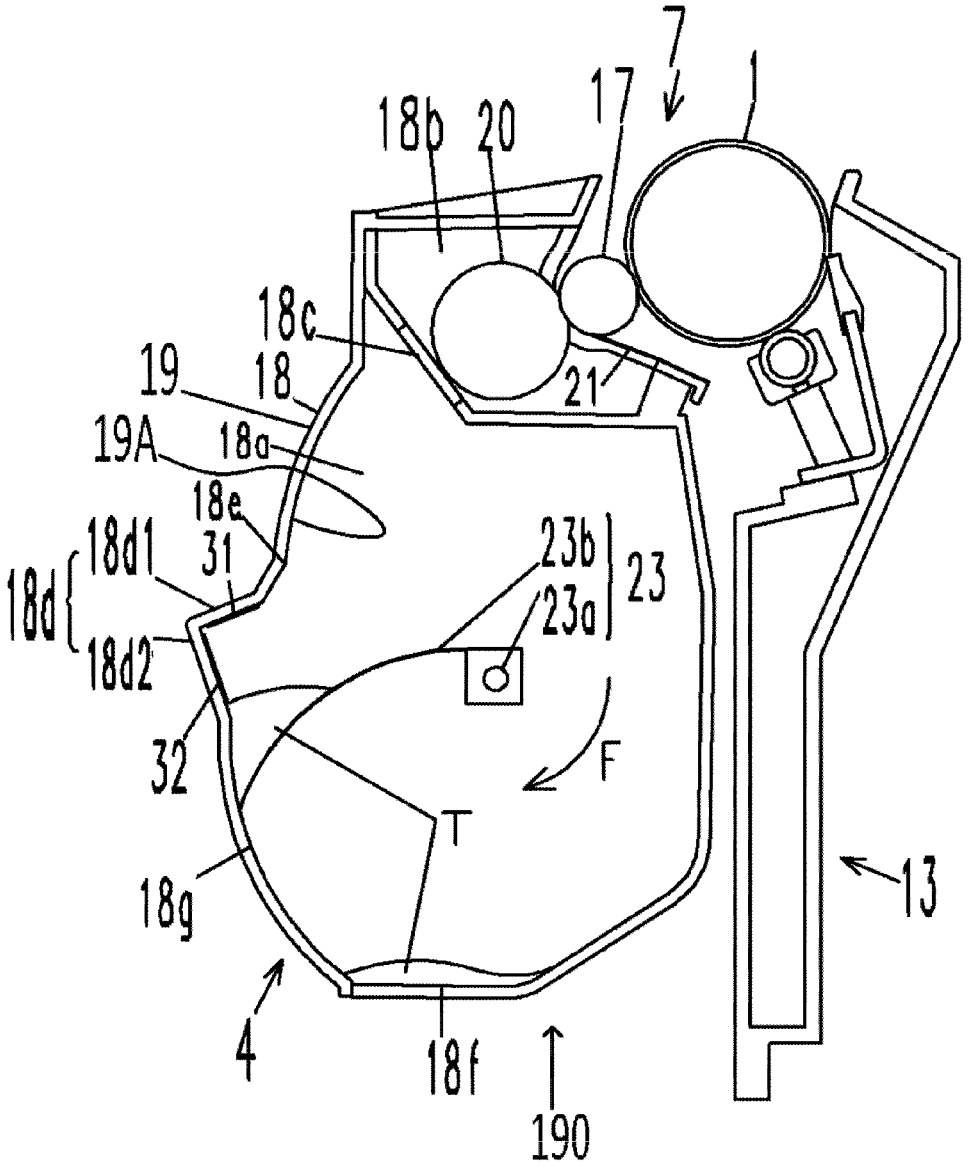
FIGS. 10A and 10B are views each showing a state in which the developer is stirred when the amount of the developer is small.
Figure 10B:
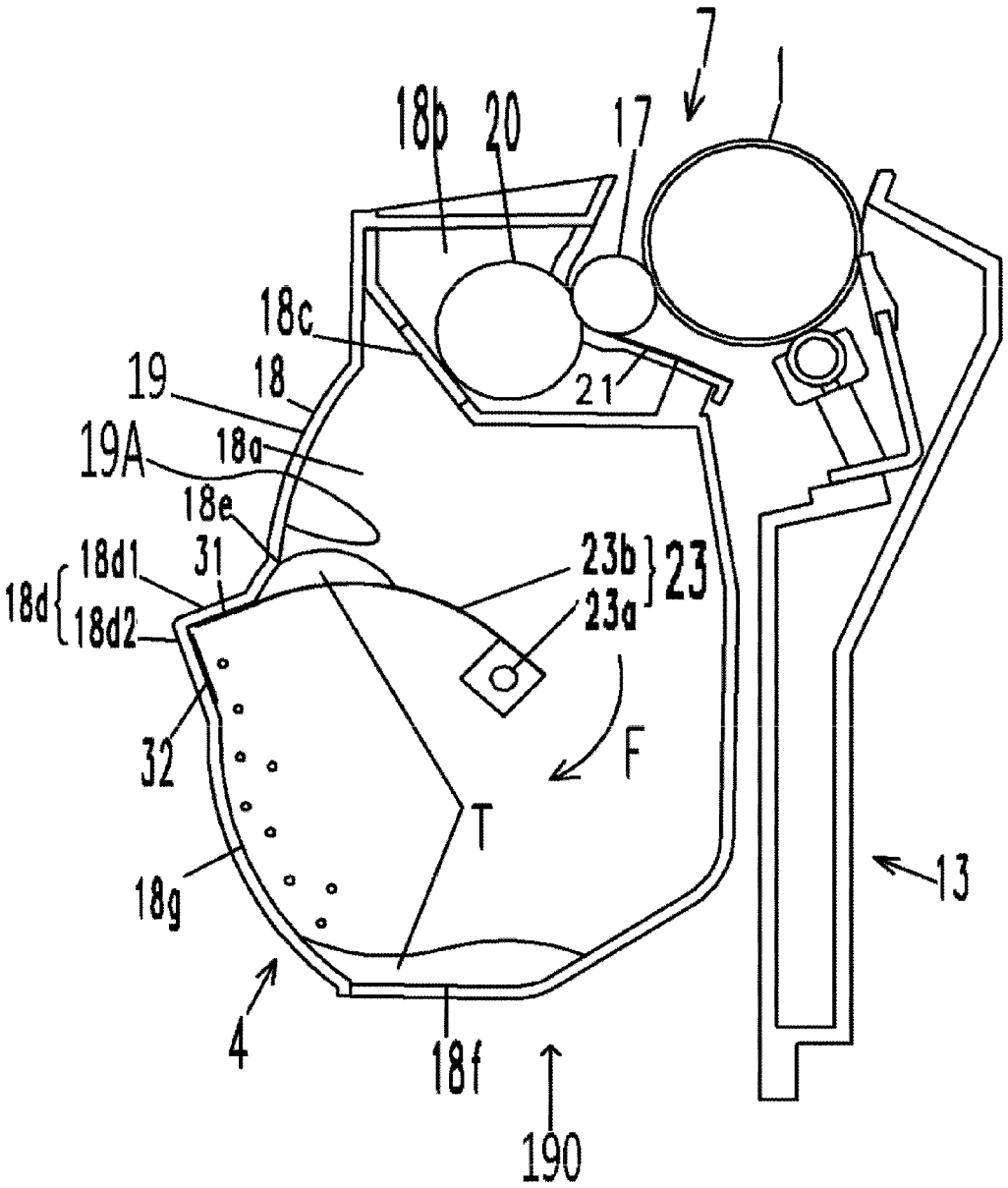

Similarly, FIGS. 10A and 10B show the states of the process cartridge 7 when the remaining toner amount in the container main body 19 is small. FIG. 10A shows a state in which the toner starts entering the region between the first conductive member 31 (as a first detecting portion) and the second conductive member 32 (as a second detecting portion). This state corresponds to timing at time t2*a* in FIG. 8, and the output voltage based on the capacitance starts decreasing at this timing. On the other hand, FIG. 10B shows the state of the process cartridge 7 immediately after the stirring sheet 23*b* passes through the concave portion 18*d*. In this state, the toner is discharged from the region between the first conductive member 31 and the second conductive member 32. This state corresponds to timing at time t2*b* in FIG. 8, and the output voltage based on the capacitance starts increasing at this timing.

As shown in FIGS. 7 and 8, a time width in which the output voltage changes when the remaining toner amount in the container main body 19 is large is longer than a time width in which the output voltage changes when the remaining toner amount in the container main body 19 is small. In the first embodiment, the remaining toner amount in the container main body 19 is detected based on the fact that a time width t in which the toner passes through the region between the first conductive member 31 and the second conductive member 32 changes with the remaining toner amount.

Figure 11:
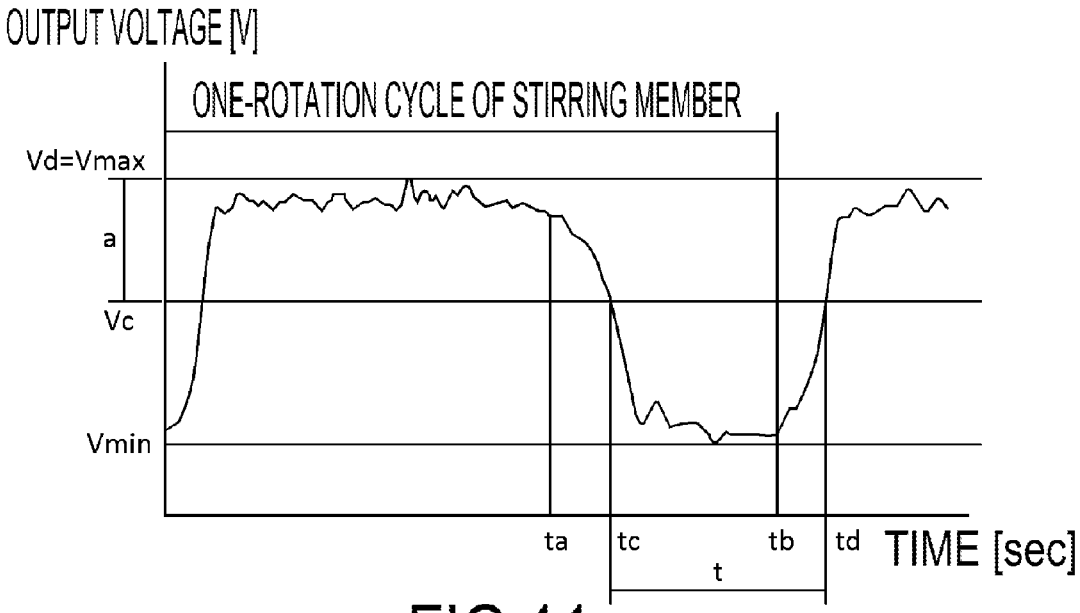
FIG. 11 is a graph showing a change in the output voltage when the developer is stirred.

Next, a description will be given, with reference to FIG. 11, of a method for measuring the time width t in which the toner passes through the concave portion from the waveform of the output voltage based on the capacitance. FIG. 11 is a graph showing the waveform of a change in the output voltage based on a change in the capacitance. As shown in FIG. 11, there is a large difference between the output voltage based on the capacitance in a state in which the toner does not exist between the first conductive member 31 and the second conductive member 32 and the output voltage based on the capacitance in a state in which the toner exists between the first conductive member 31 and the second conductive member 32. In this case, a threshold Vc is set, and detection is made as to whether the toner has entered the region between the first conductive member 31 and the second conductive member 32 based on the threshold Vc.

Here, in FIG. 11, time at which the output voltage reaches the threshold Vc when the toner enters the region between the first conductive member 31 and the second conductive member 32 is expressed as tc. In addition, time at which the output voltage reaches the threshold Vc when the toner existing between the first conductive member 31 and the second conductive member 32 is discharged is expressed as td. Further, the time width t (t=tc−td) from the time tc at which the output voltage is below the threshold Vc to the time td is measured as the time at which the toner enters the region between the first conductive member 31 and the second conductive member 32. As described above, the time width t changes with the remaining toner amount in the container main body 19. Therefore, the remaining toner amount may be estimated by the measurement of the time t.

Here, when the threshold Vc is a fixed value, the output voltage also fluctuates with fluctuations in the capacitance between the first conductive member 31 and the second conductive member 32 (as a second detecting portion). Therefore, there is a case that the time width t may not be measured based on the threshold Vc. For example, when toner having a low dielectric constant such as non-magnetic body developer is used, a change in the capacitance between the first conductive member 31 and the second conductive member 32 becomes small. As a result, a change in the detected output voltage also becomes small. In this case, it is assumed that the threshold Vc is larger than a maximum value Vmax of the output voltage (Vc>Vmax) or the threshold Vc is smaller than a minimum value Vmin (Vc<Vmin), and thus the time width t may not be stably measured.

In addition, when the dielectric constant of the toner changes with a change in an environment such as temperature and humidity at which the image forming apparatus 100 is used, the preset threshold Vc is beyond the range of the detected output voltage with an increase in fluctuations in the output voltage and thus the time width t may not be stably measured. Therefore, the threshold Vc is desirably a variable value appropriately set according to the waveform of the output voltage. In view of this, a description will be given of a method for setting the threshold Vc.

First, the maximum value Vmax or the minimum value Vmin is measured from the waveform of the detected output voltage at timing at which the remaining toner amount in the container main body 19 is acquired, and then a reference value Vd is set based on the measured value. In the first embodiment, the reference value Vd is defined as being equal to the maximum value Vmax of the output voltage (Vd=Vmax). Next, a value obtained by subtracting a preset fixed value α from the reference value Vd is set as the threshold Vc (Vc=Vd−α). Here, when the reference value Vd is defined as being equal to the minimum value (Vd=Vmin), a value obtained by adding the preset fixed value α to the reference value Vd is set as the threshold Vc (Vc=Vd+α). Note that although the maximum value Vmax or the minimum value Vmin of the output voltage is set as the reference value Vd in the first embodiment, the reference value Vd is not necessarily equal to the maximum value Vmax or the minimum value Vmin. For example, the reference value Vd may be equal to a maximum value or a minimum value of average output voltage for a few seconds.

Here, the fixed value α is a value calculated in advance in consideration of fluctuations in the arrangement relationship between the first conductive member 31 and the second conductive member 32, fluctuations in the characteristic (dielectric constant) of the toner to be used, or the like. The threshold Vc is set in the way described above, and the time width t is measured based on the threshold Vc to detect the remaining toner amount in the container main body 19. The threshold Vc is reset every time the remaining toner amount in the container main body 19 is detected and newly set based on a detected output waveform.

As described above, the threshold Vc is newly set every time the remaining toner amount in the container main body 19 is detected. Therefore, the time width t may be accurately measured, and the remaining toner amount may be stably detected. The method for acquiring the remaining toner amount described above is performed at a prescribed timing until the toner in the container main body 19 runs out in a state in which the developing unit 4 is unused and the toner is sufficiently accommodated in the container main body 19.

However, when the remaining toner amount in the container main body 19 is large and the toner enters the concave portion 18*d* at all times, the capacitance between the first conductive member 31 and the second conductive member 32 does not change and thus the output voltage is kept at an almost constant value. Therefore, the value of the time width t becomes zero even if the threshold Vc is set. In addition, when the toner in the container main body 19 runs out and thus does not enter the concave portion 18*d* even if the stirring member 23 rotates, the capacitance between the first conductive member 31 and the second conductive member 32 (as a second detecting portion) does not change and the value of the time width t becomes zero. In this case, it is not possible to determine whether the concave portion 18*d* is buried under the toner or the toner in the container main body 19 has run out. In order to avoid such a condition, processing for detecting the remaining toner amount is not performed when the time width t is prescribed time or less.

Figure 12:
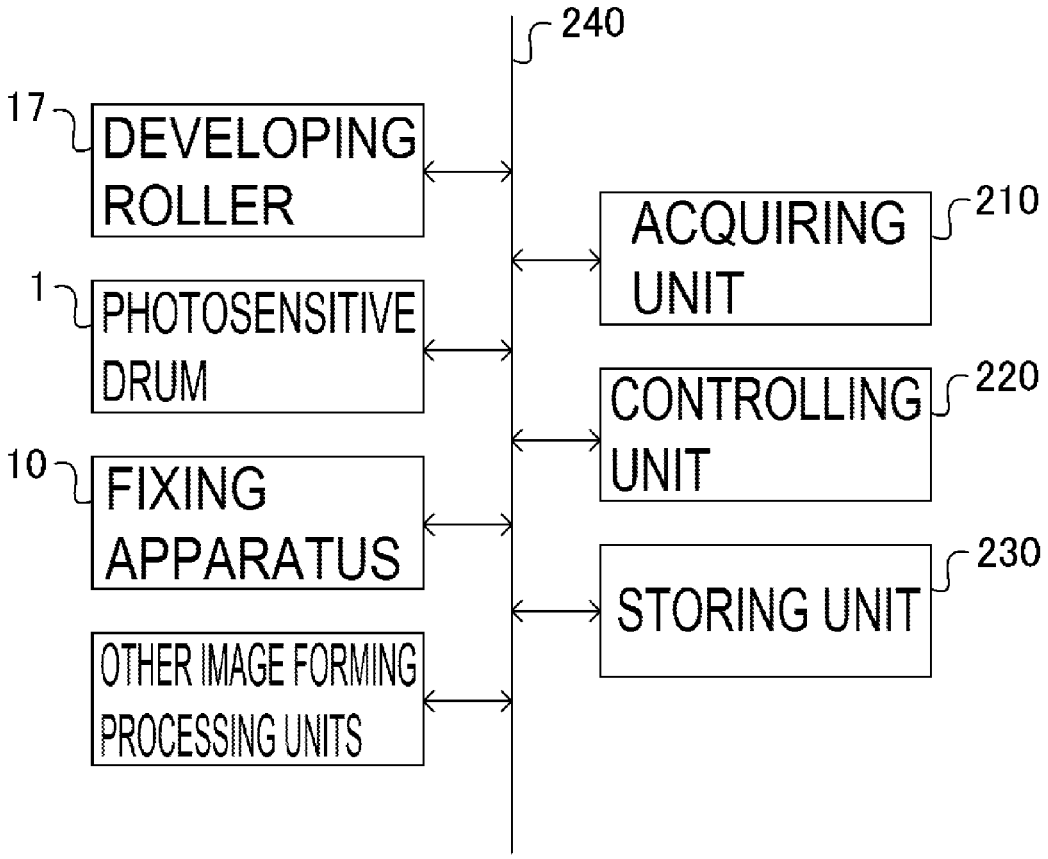
FIG. 12 is a block diagram showing the hardware configuration of the image forming apparatus.

FIG. 12 is a block diagram showing the hardware configuration of the image forming apparatus according to the first embodiment. In the image forming apparatus 100, the photosensitive drum 1, the fixing apparatus 10, the developing roller 17 (as a developer bearing member), an acquiring unit 210, a controlling unit 220, a storing unit 230, and other image forming processing units are connected to each other via a bus 240. The acquiring unit 210 performs the acquisition of the toner amount described above. The controlling unit 220 performs a program stored in the storing unit 230 to control the devices of the image forming apparatus 100. In addition, the storing unit 230 stores, besides the program performed by the controlling unit 220, the total rotation rate of the photosensitive drum 1 that will be described later, or the like.

A description will be given of a flow in which the acquisition of the toner amount is performed at a prescribed timing. Here, the prescribed timing refers to, for example, timing at which the rotation rate of the photosensitive drum 1, the number of the fixing times of the fixing apparatus 10, the rotation rate of the developing roller 17, or the like reaches a threshold. In the first embodiment, the total rotation rate of the photosensitive drum 1 or the like is stored in the storing unit 230. Then, when the total rotation rate of the photosensitive drum 1 or the like reaches a prescribed number of times, the controlling unit 220 controls the acquiring unit 210 to perform the acquisition of the toner amount.

As described above, in the first embodiment, the acquiring unit 210 does not perform the acquisition of the toner amount when the time width t is prescribed time or less. As described above, the acquiring unit 210 is controlled to acquire the toner amount at a prescribed timing and measures the time width t to acquire the toner amount. In the first embodiment, when the time width t measured by the acquiring unit 210 is prescribed time or less, the controlling unit 220 controls the acquiring unit 210 so as not to acquire the toner amount based on the detected time width t.

As described above, in the first embodiment, voltage based on the capacitance changes when the toner passes through the region between the plurality of conductive members provided in the concave portion. Then, time at which the toner enters the concave portion is measured based on the waveform of the output voltage, whereby the toner amount in the container main body may be acquired. Thus, since the output voltage changes even if the toner accommodated in the container main body has a low dielectric constant and time at which the toner enters the concave portion may be measured, the toner amount in the container main body may be stably acquired. In addition, even if the toner scatters in the container main body with the rotation of the stirring member, the toner amount in the container main body may be stably acquired.

In the first embodiment, the inner wall surfaces of the concave portion are formed to have the angles at which the toner is discharged due to its own weight. Thus, even if the toner is fed into the concave portion by the stirring member, it is discharged from the concave portion due to its own weight. If the toner in the concave portion is not discharged due to its own weight, the toner enters the concave portion at all times. Therefore, the voltage based on the capacitance between the conductive members does not change, and the toner amount in the container main body may not be acquired. In the first embodiment, the occurrence of such a problem may be prevented.

Second Embodiment

Next, a description will be given of a second embodiment with reference to FIG. 13. In the second embodiment, portions having the same functions as those of the portions of the first embodiment will be denoted by the same symbols and their descriptions will be omitted. The configuration of a process cartridge in the second embodiment is different from that in the first embodiment. In the second embodiment, a toner cartridge 90 for the replenishment of toner is attachable/detachable to/from a developing unit 80 (developing apparatus) of a process cartridge 60, and a toner amount in the toner cartridge 90 may be accurately acquired.

An image forming apparatus 100 transmits a rotation driving force to the process cartridge 60 and the toner cartridge 90. In addition, the image forming apparatus 100 applies bias (charging bias, developing bias, or the like) to the process cartridge 60. Moreover, each of the process cartridge 60 and the toner cartridge 90 is independently attachable/detachable to/from the image forming apparatus 100.

Figure 13:
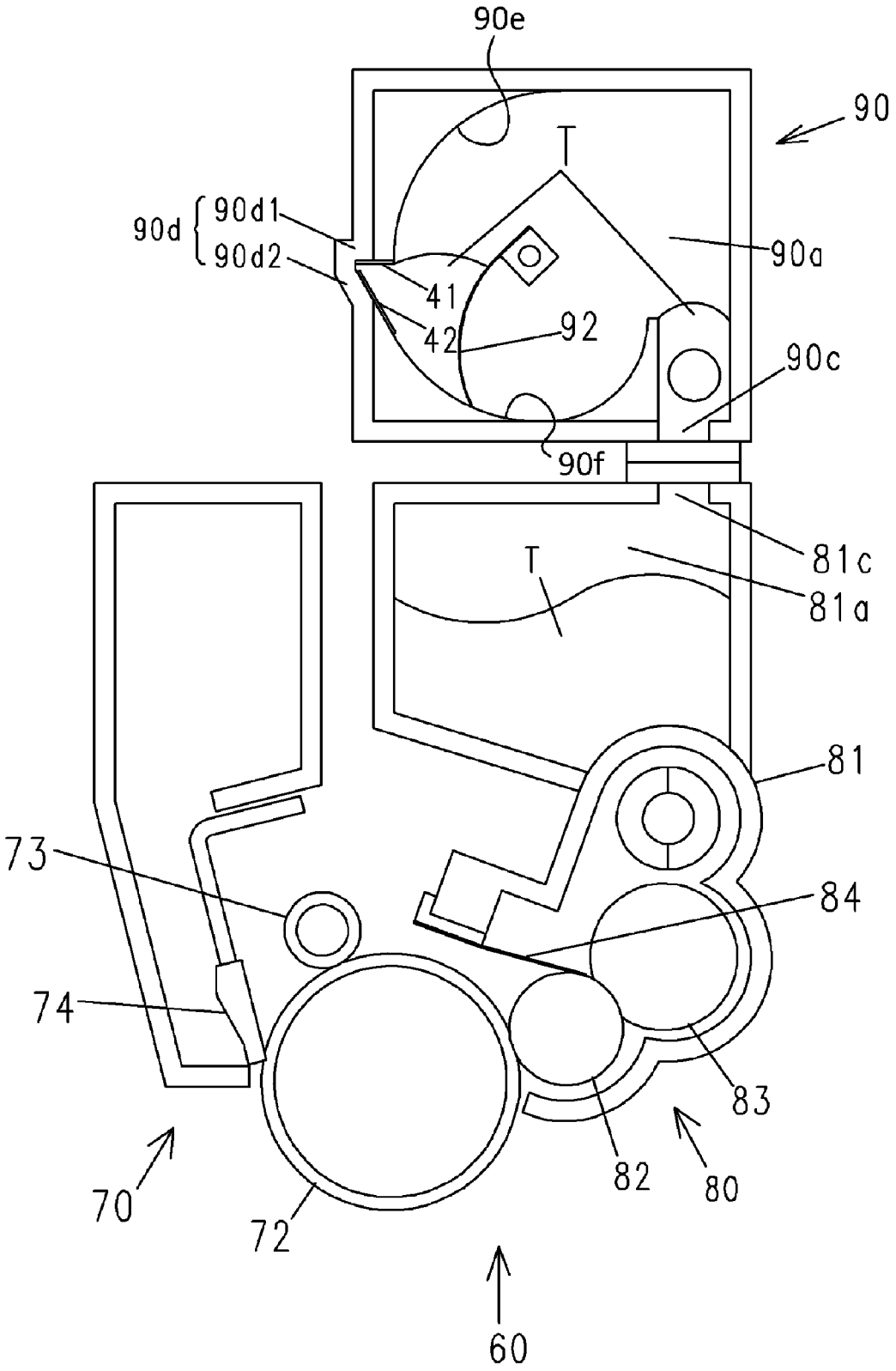
FIG. 13 is a schematic view of a process cartridge according to a second embodiment.

As shown in FIG. 13, the process cartridge 60 is constituted by a cleaning unit 70 and the developing unit 80. The cleaning unit 70 has a photosensitive drum 72 (image bearing member), a charging roller 73, and a cleaning blade 74. Since the cleaning unit 70 has the same configuration as that of the photosensitive unit 13 of the first embodiment, the detailed description of the cleaning unit 70 will be omitted. Further, the developing unit 80 has a developing roller 82, a toner supplying roller 83, a developing blade 84, and a developing frame body 81 that supports the various elements of the developing unit 80. Since the developing unit 80 has the same configuration as that of the developing unit 4 of the first embodiment, the detailed description of the developing unit 80 will be omitted. Note that the developing frame body 81 has a toner container 81*a* that accommodates toner. In addition, since the process cartridge 60 has the same developing unit and the cleaning unit as those of the process cartridge of the first embodiment, the detailed descriptions of the developing unit and the cleaning unit will be omitted.

The toner cartridge 90 has a replenishing toner container 90*a* that accommodates the toner. The replenishing toner container 90*a* has a replenishing opening 90*c* for replenishing the process cartridge 60 with the toner. In addition, the toner container 81*a* of the process cartridge 60 has a receiving opening 81*c*, and the inside of the replenishing toner container 90*a* and the inside of the toner container 81*a* communicate with each other via the replenishing opening 90*c* and the receiving opening 81*c*. When the process cartridge 60 and the toner cartridge 90 are attached to the image forming apparatus 100, the replenishing opening 90*c* and the receiving opening 81*c* communicate with each other and the toner cartridge 90 replenishes the developing unit 80 with the toner.

Next, a description will be given of a configuration to detect a remaining toner amount in the replenishing toner container 90*a* of the toner cartridge 90. As shown in FIG. 13, inside the replenishing toner container 90*a*, a replenishing toner stirring member 92 that stirs the toner and conveys the same to the replenishing opening 90*c* is provided. In addition, the replenishing toner container 90*a* has a concave portion 90*d*, and a first conductive member 41 and a second conductive member 42 are, respectively, provided on a wall surface 90*d*1 and a wall surface 90*d*2 that constitute the concave portion 90*d*. The toner enters the concave portion 90*d* when the replenishing toner stirring member 92 rotates, and the capacitance between the first conductive member 41 and the second conductive member 42 changes. Note that since the replenishing toner stirring member 92 has the same configuration as that of the stirring member 23 of the first embodiment and the concave portion 90*d* has the same configuration as that of the concave portion 18*d* of the first embodiment, the detailed descriptions of the replenishing toner stirring member 92 and the concave portion 90*d* will be omitted. In the second embodiment as well, the toner amount in the replenishing toner container 90*a* is acquired in the same way as that of the first embodiment.

As described above, the second embodiment may produce the same effects as those of the first embodiment. In addition, since the replenishing toner container 90*a* is attachable/ detachable to/from the developing unit 80 in the second embodiment, the developing unit 80 may be replenished with the toner by the replacement of the replenishing toner container 90*a*.

Third Embodiment

Figure 14:
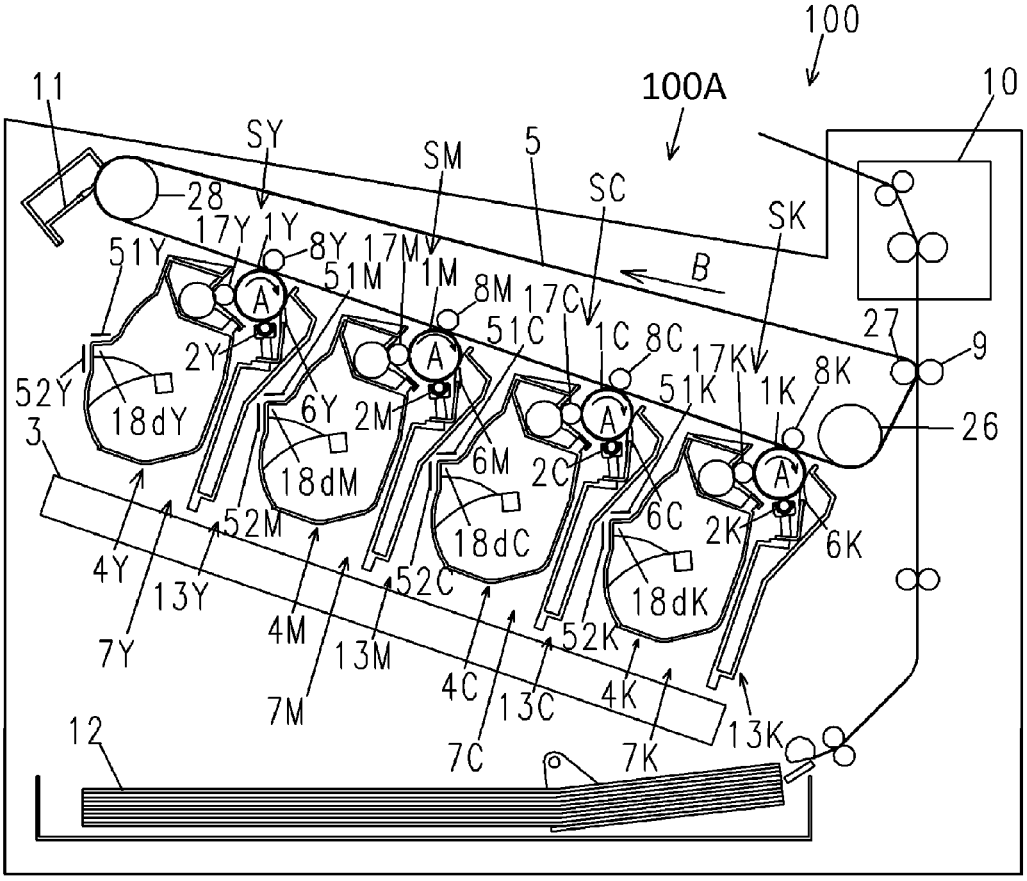
FIG. 14 is a schematic view of an image forming apparatus according to a third embodiment.

Next, a description will be given of a third embodiment. In the third embodiment, portions having the same functions as those of the portions of the first embodiment will be denoted by the same symbols, and their descriptions will be omitted. In the third embodiment, a first conductive member and a second conductive member are provided on the side of an image forming apparatus. In the third embodiment, the image forming apparatus, a process cartridge, or the like has the same configuration as that of the image forming apparatus, the process cartridge, or the like of the first embodiment. In the third embodiment, as shown in FIG. 14, a first conductive member 51 and a second conductive member 52 are provided on the side of an image forming apparatus 100.

In the third embodiment, a process cartridge 7 is attachable/detachable to/from the image forming apparatus 100 like the first embodiment. As described above, in the third embodiment, the first conductive member 51 (51Y, 51M, 51C, and 51K) and the second conductive member 52 (52Y, 52M, 52C, and 52K) are provided on the side of the main body of the image forming apparatus 100 rather than being provided on the side of a container main body 19. The first conductive member 51 and the second conductive member 52 are provided on the side of the image forming apparatus 100 so as to sandwich space in a concave portion 18*d* between them. Thus, like the first embodiment, detection is made as to whether toner has entered the concave portion 18*d* with voltage based on the capacitance between the first conductive member 51 and the second conductive member 52, and a toner amount in the container main body 19 is acquired.

As described above, the third embodiment may produce the same effects as those of the first embodiment. In addition, in the third embodiment, the first conductive member and the second conductive member are provided on the side of an apparatus main body 100A of the image forming apparatus rather than being provided on the side of the process cartridge. Therefore, the first conductive member and the second conductive member may be used as they are when the process cartridge is replaced. Thus, the number of the components of the process cartridge may be reduced, and the recyclability of the process cartridge may be improved.

Note that in each of the embodiments, the threshold is calculated by subtracting the fixed value from the reference value or adding the fixed value to the reference value. However, the fixed value may not be necessarily a constant value. For example, the fixed value may be a value that changes with the rotation rate of the developer bearing member or the like.

In addition, in each of the embodiments, the threshold is calculated by subtracting the fixed value from the reference value or adding the fixed value to the reference value. However, the fixed value may not be necessarily used to calculate the threshold. For example, the threshold may be calculated from a table on the corresponding relationship between the reference value and the threshold.

Moreover, in each of the embodiments, the threshold is changed using the maximum value or the minimum value of the voltage as the reference value. However, this method may not be necessarily used to calculate the threshold. For example, the threshold may be calculated from the average value of the voltage at time at which a remaining developer amount is acquired.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-039329, filed Feb. 27, 2015, which is hereby incorporated by reference herein in its entirety.

What is claimed is:

1. A developing apparatus comprising:

a developing chamber that has a developer bearing member bearing developer;

an accommodating chamber that has a concave portion and an opening and accommodates the developer under the developing chamber;

a conveying member that conveys the developer by rotation; and a first detecting portion and a second detecting portion for detecting an amount of the developer in use of capacitance, wherein a part of the concave portion is at least within a turning radius of the conveying member, the first detecting portion is provided on a downstream side in a rotating direction of the conveying member relative to the concave portion, and the second detecting portion is provided on an upstream side in the rotating direction of the conveying member relative to the concave portion.

2. The developing apparatus according to claim 1, wherein the conveying member has a rotating shaft and a sheet member, and an end of the sheet member is attached to the rotating shaft, so that the sheet member conveys the developer in the accommodating chamber due to rotation of the rotating shaft.

3. The developing apparatus according to claim 2, wherein the part of the concave portion is positioned above the rotating shaft of the conveying member.

4. The developing apparatus according to claim 1, wherein a length of the concave portion in a longitudinal direction of the developing apparatus is longer than a length of the sheet member in the longitudinal direction.

5. The developing apparatus according to claim 1, wherein a shape of the concave portion when seen along the longitudinal direction of the developing apparatus is a triangle.

6. The developing apparatus according to claim 1, wherein the concave portion is provided on an upstream side of the developer bearing member in the rotating direction of the conveying member.

7. The developing apparatus according to claim 1, further comprising:

a first contact electrically connected to the first detecting portion; and a second contact electrically connected to the second detecting portion, wherein voltage is applied to the first detecting portion and the second detecting portion via one of the first contact and the second contact when the first contact and the second contact are electrically connected to a voltage applying portion, which is used to apply the voltage to the first detecting portion and the second detecting portion and provided in an apparatus main body, in a state in which the developing apparatus is attached to the apparatus main body of the image forming apparatus.

8. A process cartridge comprising:

the developing apparatus according to claim 1; and an image bearing member that bears a developer image.

9. An image forming apparatus forming an image on a recording medium in use of developer, comprising;

the developing apparatus according to claim 1.

10. An image forming apparatus comprising:

the developing apparatus according to claim 7;

a first main-body-side contact electrically connected to the second detecting portion, and a second main-body-side contact electrically connected to the second detecting portion, and a voltage applying portion that is used to apply voltage to the first detecting portion and the second detecting portion and electrically connected to one of the first main-body-side contact and the second main-body-side contact.

11. A developer container detachable from a developing unit having a developer bearing member, the developer container comprising:

an accommodating chamber that has a concave portion and an opening and accommodates developer;

a conveying member that conveys the developer by rotation; and a first detecting portion and a second detecting portion that detect an amount of the developer in use of capacitance, wherein a part of the concave portion is within a turning radius of the conveying member, the first detecting portion is provided on a downstream side in a rotating direction of the conveying member relative to the concave portion, and the second detecting portion is provided on an upstream side in the rotating direction of the conveying member relative to the concave portion.

12. An apparatus main body of an image forming apparatus from which a developer container is detachable, the developer container having an accommodating chamber that has a concave portion and an opening and accommodates developer and also having a conveying member that conveys the developer by rotation, a part of the concave portion being within a turning radius of the conveying member, the apparatus main body comprising:

a first detecting portion and a second detecting portion that detect a change in an amount of the developer in the developer container in use of capacitance when the developer container is attached to the apparatus main body; and a voltage applying portion that applies voltage to the first detecting portion and the second detecting portion, wherein the first detecting portion is provided on a downstream side in a rotating direction of the conveying member relative to the concave portion, and the second detecting portion is provided on an upstream side in the rotating direction of the conveying member relative to the concave portion.

13. The developing apparatus according to claim 1, wherein the first and second detecting portions are sheet members.

14. The developing apparatus according to claim 1, wherein the first and second detecting portions are conductive resins.

15. The developing apparatus according to claim 1, wherein the first and second detecting portions are provided on a part of the concave portion.

16. The developing apparatus according to claim 1, wherein the first and second detecting portions are located at least within a turning radius of the conveying member.

17. The developing apparatus according to claim 1, wherein the first and second detecting portions are located for detecting a change in capacitance inside the concave portion.

* * * * *